United States Patent [19]

Yamane et al.

[11] Patent Number: 5,009,931

[45] Date of Patent: Apr. 23, 1991

[54] COATING METHOD

[75] Inventors: Takakazu Yamane; Yoshio Tanimoto; Tadamitsu Nakahama, all of Hiroshima, Japan

[73] Assignee: Mazda Motor Corporation, Hiroshima, Japan

[21] Appl. No.: 390,546

[22] Filed: Aug. 8, 1989

[30] Foreign Application Priority Data

Aug. 9, 1988 [JP] Japan ..... 63-197038

[51] Int. Cl.[5] ..... B05D 3/12

[52] U.S. Cl. ..... 427/195; 427/27; 427/240; 427/223; 427/282; 427/371; 427/388.1; 427/421; 427/425

[58] Field of Search ..... 427/240, 421, 388.1, 427/425, 371, 195, 282, 273, 27

[56] References Cited

U.S. PATENT DOCUMENTS 4,702,968 10/1987 Masuhara et al. ..... 427/409 X
4,731,290 3/1988 Chang ..... 427/409
4,741,932 5/1988 Ichimura et al. ..... 427/409

*Primary Examiner*—Janyce Bell
*Attorney, Agent, or Firm*—Fish & Richardson

[57] ABSTRACT

A highly reflective surface coating is formed by spraying a paint on a substrate as a vehicle body in a thickness thicker than a thickness at which the paint sags and rotating the substrate about its horizontal axis at a speed between a lower limit and an upper limit in order to cause no sagging until the paint sprayed is cured to a sagless state.

Before the paint is sprayed in that thickness, an edge portion of the substrate is lowered than other portions thereof, thus preventing a mass of the paint from swelling on a top coat at its edge portion and providing a good appearance on the surface coating.

The lowering of the edge portion thereof is effected by lowering the substrate itself without any coat or by spraying the edge portion in a film thickness thinner than the other portion thereof.

The coat sprayed with a paint containing a volatilizable solvent may be dried through sequential setting and baking steps, while a powder paint sprayed may be baked without setting. The paint containing such a solvent may cause sagging in both the setting and baking steps or only in the setting step. The sagging is prevented by rotating the substrate during the time when the paint is sagging.

68 Claims, 11 Drawing Sheets

COATING METHOD

BACKGROUND OF THE INVENTION

1. Field of the Invention

The present invention relates to a coating method.

2. Description of Related Art

A coating method for coating an outer surface of a substrate such as a vehicle body generally includes a preparation step for preparing for the substrate to be coated with a paint by removing dust or other foreign materials from the substrate, a coating step for spraying the substrate with the paint, and a drying step for drying the coat thereon. The drying step generally comprises sequential setting and baking steps in particular when a thermosetting paint is used. The setting step is usually carried out prior to the baking step at an ambient temperature which is lower than the ambient temperature during the baking step, for example, at room temperature or at temperatures ranging from 40° C. to 60° C., in order to volatilize a solvent slowly so as to prevent a formation of pinholes on the coat surface during the baking step which is usually carried out at approximately 140° C.

The substrate is held at a given position on a conveyance means such as a carriage while being conveyed during the preparation, coating, and drying steps.

A degree of flatness or smoothness on the surface of a coat on the substrate is one of standards for evaluating a quality of the coat. The higher a degree of flatness the smaller a degree of irregularities on the coat surface, thus producing a better coat. It is well known that a thicker film thickness of a paint may give a higher degree of flatness on a coat surface. A paint sprayed on the surface of a substrate may be said to sag when it is visually observed that the paint sprayed thereon flows and finds a trace of movement on the coat by 1 mm to 2 mm from a site where the paint was sprayed until it is cured in the drying step. It may be defined herein that a sag of the paint occurs if such a trace exceeds at least 2 mm when visually observed. In other words, a sagging limit thickness of a paint is a film thickness beyond the maximum film thickness at which the paint does not sag at least in the drying step if it is left as it was sprayed. Thus, a film thickness of the paint within its sagging limit thickness is a film thickness in which it does not sag in the drying step even if it is left as it was sprayed. On the contrary, a film thickness thicker than its sagging limit thickness of the paint is a film thickness at which the paint causes sagging at least during the drying step when it is stayed as it was sprayed.

The paint causes sagging when the paint coated thereon flow downwardly due to gravity. The paint becomes more likely to cause sagging as a film thickness of the paint sprayed gets thicker. Thus it is a matter of course that the paint sags more likely on a surface of the substrate extending in an up-and-downward direction, i.e., a vertically extending surface, than on a surface thereof extending in a horizontal direction, i.e., a horizontally extending surface. This enables the paint to be coated on the horizontally extending surface in a film thickness thicker than on the vertically extending surface because the sags or drips of the paint little affect adversely the coat sprayed on the horizontally extending surface of the substrate. If the film thickness of a coat on the horizontally extending surface is the same as that on the vertically extending surface, the former can produce a coat with a degree of flatness higher than the latter because the paint sprayed on the horizontally extending surface becomes flattened due to a natural flow in the paint to an extent to which no sags substantially occur.

Conventionally, in order to provide a coat with a higher degree of flatness while preventing sags or drips of a paint coated on a surface of the substrate, there have been used paints which are lower in viscosity and less flowable. Even if such a thermosetting paint is used, however, a sagging limit thickness of the paint sprayed on the vertically extending surface is as high as approximately 40 μm. This sagging limit thickness is the maximum film thickness in which the paint does not substantially sag on the vertically extending surface of a substrate. In other words, the paint is likely to sag or drip in initial stages of the setting and baking steps, particularly in the initial stage of the baking step. Accordingly, a film thickness of the coat is determined by a film thickness of the paint to be sprayed on the surface of a substrate to such an extent that the paint does not sag on its vertically extending surface. In order to produce a coat in a film thickness thicker than a sagging limit thickness of the paint, the spraying step is repeated twice or more in conventional coating method.

Attempts have been made to compete with the problem with spraying the paint in a film thickness thicker than its sagging limit thickness, and we have developed a technology that enables forming a coat having coat properties superior to coats obtainable by conventional coating methods, when sprayed in the same film thickness, as disclosed in our U.S. patent application Ser. No. 100,767. This technology involves spraying a vehicle body with the paint in a film thickness thicker than its sagging limit thickness and rotating the body about its substantially horizontal axis at least until the paint in the coat sprayed thereon is cured so as to cause no sagging any more. This coating method rather takes advantage of gravity that causes sags of the paint sprayed and the substrate is rotated so as to alter its direction in which gravity acts on the coat surface on the body, thereby preventing sags from occurring in the coat thereon while positively utilizing a flowability inherent in the paint and yielding a coat with a higher degree of flatness than coats obtainable by conventional coating methods. Thus this technology is an excellent coating method in itself.

It has now been found, however, that there is still a room for improvement in the above-described technology because, when a highly flowable paint is sprayed in a film thickness thicker than its sagging limit thickness, the paint sprayed on the substrate may swell on an edge portion thereof to form a mass of the paint. As a result of review on this problem with reference to schematic views as shown in FIGS. 28 to 30, it has been found that the highly flowable paint sprayed gets flattened by means of a surface tension acting upon the coat surface, as shown in FIGS. 28 and 29, but, once flattened, the paint then moves in one direction as indicated by the arrow E toward the edge portion T of the substrate W by means of a surface tension and gathers on the edge portion T, forming a swelled mass 100 of the paint as shown in FIG. 30.

It is to be noted that the swelled mass of the paint on the edge portion of the substrate gets larger as the paint becomes more flowable and/or a film thickness of the paint coated on the substrate becomes thicker, thus impairing an appearance. In other words, although a coat surface of a high degree of flatness is provided by taking advantage of a flowability of the paint, a largely swelled mass of the paint on the edge portion of the vehicle body may adversely affect the appearance of the vehicle.

SUMMARY OF THE INVENTION

Therefore, the present invention has the object to provide a coating method which permits preventing the paint from swelling on an edge portion of a substrate so as to form no largely swelled mass of the paint thereon, in which the paint is sprayed in a film thickness thicker than the thickness at which the paint sags and the rotation of the substrate is carried out about its substantially horizontal axis.

In order to achieve the object, the present invention consists of a coating method in a coating line for coating a substrate with a paint in a film thickness thicker than a thickness at which the paint sags to form a highly reflective surface coating on the substrate, comprising: a spraying step in which the paint is sprayed to form a coat in a film thickness thicker than a thickness atwhich the paint sags on a surface extending at least upwardly and downwardly; and a drying step in which the substrate is rotated about its horizontal axis until the paint sprayed thereon achieves a substantially sagless state, the rotation of the substrate being carried out at a speed which is high enough to rotate the substrate from a vertical position to a horizontal position before the paint coated thereon substantially sags due to gravity yet which is low enough so as to cause no sagging as a result of centrifugal force; wherein a surface at an edge portion of the substrate to be coated is lower than the other portion thereof before the paint is sprayed in the spraying step in a film thickness thicker than the thickness at which the paint sags.

In accordance with the present invention, the edge portion of the substrate where the paint is likely to swell after a coat surface gets flattened is lowered than the other portion in advance prior to the spraying of the paint in a film thickness thicker than the thickness at which the paint sags, so that the surface of the coat formed on the lowered portion thereof incurs no risk of getting the paint swell thereon to a large extent after the coat sprayed is dried.

It is to be noted that there are several ways of making an edge portion of the surface of the substrate lower in advance before the paint is sprayed in a film thickness thicker than the thickness at which the paint sags. For instance, the substrate can be processed to make its edge portion lower. In this case, the spraying can be effected to form a coat having a film thickness thicker than the thickness at which the paint sags, without paying any or little attention to the problem with the swelling of the paint on its edge portion. Alternatively, the edge portion of the substrate is previously sprayed with the paint in a film thickness thinner than the thickness at which the other portion is sprayed, before the paint is sprayed on the edge portion thereof in a film thickness thicker than the thickness at which the paint sags. In other words, a film thickness of the coat on the edge portion of the substrate is thinner than the film thickness of the coat on the other portions thereof.

As have been described hereinabove, the number of sprayings may vary with a state of the edge portion of the substrate prior to the spraying of the paint thereon in a film thickness thicker than the thickness at which the paint thereon sags, i.e., a sagging limit thickness. Thus the paint may be sprayed once in a sagging limit thickness or in several stages, namely, twice or more, so as to eventually form a coat in a film thickness thicker than its sagging limit thickness. It is to be understood herein that, when the paint is sprayed in multiple stages, it is preferred that a thickness of the coat on the edge portion of the substrate becomes thinner than the thickness of the coat on the other portions thereof before the film thickness on the edge portion becomes thicker than its sagging limit thickness.

Thus the present invention permits spraying of the paint by means of an electrostatic spraying which is particularly likely to cause swelling the paint on the edge portion of the substrate.

As have been described hereinabove, it is further to be understood that the paint is determined herein to sag when it is visually observed that the paint flows generally by approximately 2 mm if it is stayed as it was sprayed. Sags of the paint are left as marks on the coat surface in a string-like form when the paint is cured. Thus the spraying of the paint in a film thickness thicker than its sagging limit thickness results in the fact that the paint flows in a length longer than 2 mm when it is stayed untreated as it was sprayed. It is found as a matter of course that the higher a flowability of the paint the thinner its sagging limit thickness of the paint to be sprayed. It is also to be noted that the rotation of the substrate be carried out about its substantially horizontal axis in such a manner that the paint sprayed is not caused to move to a large extent due to gravity. The substrate may be rotated continuously or intermittently in one direction or in alternate directions until the paint gets cured and as a result becomes in a substantially sagless state. Furthermore, an angle at which the substrate is rotated about its horizontal axis is approximately 270 degrees because it is sufficient that a direction can be reversed, in which gravity acts upon a site sprayed with the paint in a film thickness above its sagging limit thickness. The axis about which the substrate is rotated may be inclined at approximately 30 degrees relative to the real horizontal axis thereof or may be pivoted.

The other objects and features of the present invention will become apparent in the course of the description of this specification.

DETAILED DESCRIPTION OF THE PREFERRED EMBODIMENTS

Outline of Coating Method

Figure 1:
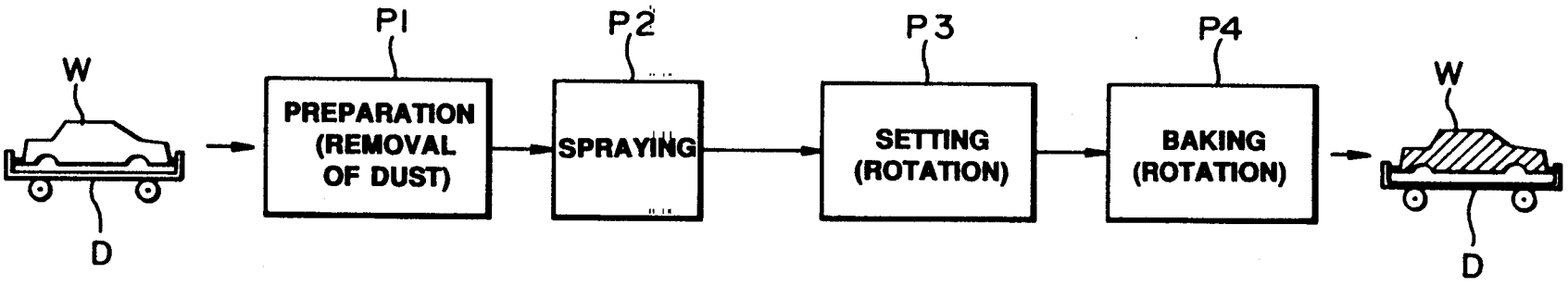
FIG. 1 is a schematic diagram showing an outline of the coating method according to the present invention.

FIG. 1 shows an outline of the steps for placing the coat on a substrate, as a vehicle body W. In FIG. 1, P1 to P4 denote each of the steps constituting the coating step which comprises a preparation step P1, a spraying step P2, a setting step P3, and a baking step P4. In this specification, the terms "drying step" is intended to mean a sequential combination of thesetting step P3 with the baking step P4, unless otherwisestated specifically.

A vehicle body W is coated first with an undercoat by means of the electrodeposition coating method and then with an intermediate coat in a conventional manner. The vehicle body W is then loaded on a carriage D and conveyed to the preparation step P1. The carriage D is provided with a rotation driving unit to rotate the vehicle body W utilizing the restoring force of a spring, as weill be described in more detail hereinafter.

In the preparation step P1, the vehicle body W is cleaned. Foreign material is removed by blowing air or by vacuum suction.

In the spraying step P2 a coat is sprayed on the vehicle body W conveyed from the preparation step P1.

The sprayed coat is cured and baked in the setting step P3 and the baking step P4. In the setting and baking steps P3 and P4 the vehicle body W is rotated using the restoring force of the spring in the manner described hereinafter.

The vehicle body W baked in the baking step P4 is then conveyed to a series of overcoating procedures and sprayed with an overcoating paint in the spraying step P2 and the overcoat was dried in the drying step. If the coating procedures from the step P1 to P4 are for coating the body W with the overcoating paint, the body W overcoated is then conveyed to an assembly line in conventional manner.

Removal of Foreign Materials

Figure 2:
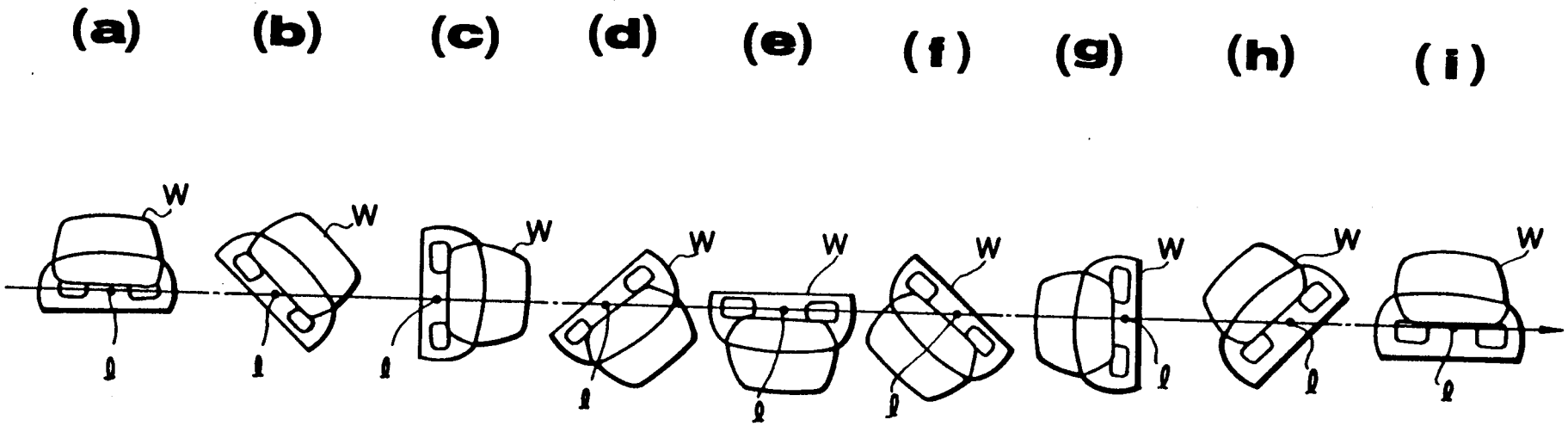
FIG. 2 is a schematic diagram showing a variation of positions of a vehicle body at which it is rotated.

Foreign materials such as dirt may be removed in the preparation step P1 as the vehicle body W is rotated about the horizontal axis 1 as shown in FIG. 2. For instance, the vehicle body W is first rotated to the position (a) in FIG. 2 and suspended at that position to clean it by removing the foreign materials. The carriage D may then be operated to rotate the vehicle body W to the position (b) and to suspend it at that position to do cleaning work. This operation may be likewise repeated to rotate the vehicle body W continuously or intermittently from the position (b) through (c), (d), (e), (f), (g) and (h) to the position (i). And it is a matter of course that the rotation of the vehicle body W may be reversed at any position and returned to the original position (a).

The rotation of the vehicle body W in the preparation step P1 permits removal of foreign materials which are adhereing to the corner portions inside the roof panel, closed sections of side sills, or other places in which it is unlikely that the foreign materials would be thoroughly removed unless the vehicle body W is rotated to cause them to fall out.

Spraying And Drying

The vehicle body W may be preferably sprayed with the paint in the spraying step P2 in such a manner that the paint sprayed on the surface of the body W sags at least in one of the setting step P3 and the baking step P4 yet causes no sagging at least in approximately two minutes after completion of the spraying step P2 and transferal of the substrate to the following step. The time as long as two minutes is set on the basis of the fact that approximately two minutes will be required until an entire portion of the body W has been sprayed with the paint from the start of spraying and the body W has then been transferred to the setting step P3. This means that the paint sprayed causes no sagging at a portion which has first been sprayed until the spraying of the whole body is finished, thereby ensuring a prevention of sagging in the spraying step P2. The spraying is preferably effected by means of electrostatic coating or spraying.

The spraying is a preferred feature of coating the body W with the paint because it permits a ready management and control over a film thickness of the coat to be sprayed on the surface of the body W. It is to be understood herein that the electrostatic coating is to be contained in this concept of spraying.

It should be noted that the spraying referred to herein is thoroughly different from dipping. Dipping of the body in a bath of the paint apparently causes the paint to drip and sag from the surface of the body at the instance at which the body was drawn up from the paint bath. At that time, the paint on the surface of the body moves in a length that is longer than 1 to 2 mm when visually observed. This magnitude is much larger than a sagging limit thickness of the paint used. Even if the body coated with the paint in such a thick film thickness would be rotated, a portion where the paint has sagged can provide no coat surface which is as smooth or flat as other portions where no sagging has been caused.

In accordance with the present invention, as the coat sprayed on the surface of the body W is caused to sag in either of the setting step P3 or the baking step P4, the film thickness can be thicker than the possible thickest film thickness obtainable by means of conventional procedures. It is a matter of course that, in accordance with the present invention, the coat may have a film thickness as thick as or thinner than conventional one.

The body W coated in the spraying step P2 in such a state as causing no sagging is then conveyed to the drying step which usually consists of the setting step P3 and the baking step P4.

Rotation of The Substrate

In the setting step P3, the vehicle body W is rotated about its horizontal axis, for instance, in such a manner as shown in FIGS. 2(*a*) to (*i*), an axis extending horizontally in the longitudinal direction of the body W and the rotation of the body W being carried out about its horizontal axis l continuously or intermittently in one direction or in alternate directions.

Referring to FIG. 2, FIG. 2(*a*) shows an original position at which the body W is mounted on the carriage. FIG. 2(*b*) shows a position of the body W in which it is rotated at 45 degrees from the original position of FIG. 2(*a*). FIGS. 2(*c*), (*d*), and (*e*) show positions at which it is rotated at 90 degrees, 135 degrees, and 180 degrees, respectively, from the original position thereof. As shown in FIGS. 2(*f*), (*g*), and (*h*), the body W is further rotated at 225 degrees, 270 degrees, and 315 degrees, respectively, from the original position shown in FIG. 2(*a*). FIG. 2(*i*) shows the position at which the body is rotated at 360 degrees from and returned to the original position of FIG. 2(*a*). It should be understood that FIG. 2 is shown merely as references and that the body W may take any position. The rotation of the body W may be carried out on the carriage continuously or intermittently in one direction or in alternate directions in a cycle of rotation in which the body W is turned about its horizontal axis so as to allow every vertically cross-sectional portion of the body W passing through the center of its horizontal axis to pass in equal occasions through the direction of gravity passing through the center thereof. If the body W is rotated in one direction, the rotation may be continuously or intermittently carried out in a clockwise direction in FIG. 2, for example, in a cycle from the original position of FIG. 2(*a*) through FIGS. 2(*b*), (*c*), (*d*) (*e*), (*f*), (*g*), and (*h*) to the original position of FIG. 2(*i*). If it is rotated continuously or intermittently in alternate directions, the rotation may be carried out first in the clockwise direction in FIG. 2, for example, in a first quarter of one cycle from the original position of FIG. 2(*a*) through FIG. 2(*b*) to the position of FIG. 2(*c*) and then reversed back in a counterclockwise direction in a second quarter thereof from FIG. 2(*c*) through FIG. 2(*b*) to the original position of FIG. 2(*a*) and then in a third and quarter thereof from the original position of FIG. 2(*i*), i.e., FIG. 2(*a*), through FIG. 2(*h*) to the position of FIG. 2(*g*). In this case, the rotation of the body W is reversed again in a counterclockwise direction in a fourth quarter of one cycle from the position of FIG. 2(*g*) through FIG. 2(*h*) to the original position of FIG. 2(*i*), namely, FIG. 2(*a*). Furthermore, for example, if the rotation of the body W is reversed at the angle of 135 degrees, the body W is rotated first in a clockwise direction from the original position of FIG. 2(*a*) through FIGS. 2(*b*) and 2(*c*) to FIG. 2(*d*), and the rotation is reversed back in a counter-clockwise direction therefrom through FIGS. 2(*c*) and (*b*) to FIG. 2(*a*). The body W is continued to be rotated therefrom, namely, from FIG. 2(*i*) through FIGS. 2(*h*), (*g*) to FIG. 2(*f*) and then reversed again in a clockwise direction therefrom through FIGS. 2(*g*) and (*h*) to FIG. 2(*i*), namely, to the original position of FIG. 2(*a*). It is to be noted that the rotation of the body W may be reversed at any angle and it is not restricted at any means to those as have been described hereinabove. The angle at which the rotation of the vehicle body W is reversed may be determined on the basis of a direction in which gravity acts on the coating particularly on the up-and-downward direction and of a shape of the vehicle body W, particularly a location of its corner portions, and the like. Furthermore, it is to be noted that the rotation may be carried out intermittently in such a manner that the rotation is continued by repeating a run-and-stop operation.

A speed of the rotation of the vehicle body W may be determined depending upon a viscosity of the paint and a film thickness thereof coated on the surface of the body W and may vary within the range between the maximum value and the minimum value, a maximum value being defined as the maximum rotational speed at which the paint coated thereon causes no sagging as a result of centrifugal force and a minimum value being defined as the minimum rotational speed at which the surface is rotated from its vertical state to its horizontal state before the paint on the coating surface substantially sags due to gravity. The body W is preferably rotated at a speed of 380 cm per second or lower as measured at a radially outward tip portion of the body.

An angle at which the body W is rotated about its substantially horizontal axis may be inclined at approximately 30 degrees, preferably at approximately 10 degrees, with respect to its horizontal axis.

A period of time when the rotation of the vehicle body W is carried out is sufficient if it lasts at least from the instance when the coating starts sagging to the instance when the coating is cured to such an extent to cause no sagging during the drying step. It is also possible to carry out the the rotation all over the drying step for any reasons including instrumental demands and so on.

An ambient temperature in the setting step P3 may be as high as 40° C. to 60° C., although the ambient temperature is set at room temperature in this embodiment, a temperature being set in a range which is lower than an ambient temperature during the baking step P4. The setting step P3 is to volatilize components volatile at low boiling points in the paint of the coating, thereby preventing an occurrence of pinholes on the coat surface due to rapid volatilization of components having such low boiling points.

In the baking step P4, the coat on the surface of the vehicle body W is baked at an ambient temperature as high as, for example, 140° C. When the paint used for coating the body W is of the type that sags in the baking step P4, the body W may be rotated about its horizontal axis in the manner, for example, as shown in FIGS. 2(*a*) to (*i*), in substantially the same manner as in the setting step P3 as have been described hereinabove.

The rotation of the body W during the setting step P3 and/or the baking step P4 permits drying the coat on the body W without leaving any marks or scars of sags on the coat surface while providing a highly reflective surface coat on the body with a degree of smoothness higher than coat surfaces obtainable by conventional methods.

Relationship of Film Thickness of Paint with Speed of Paint Sagging

Figure 3:
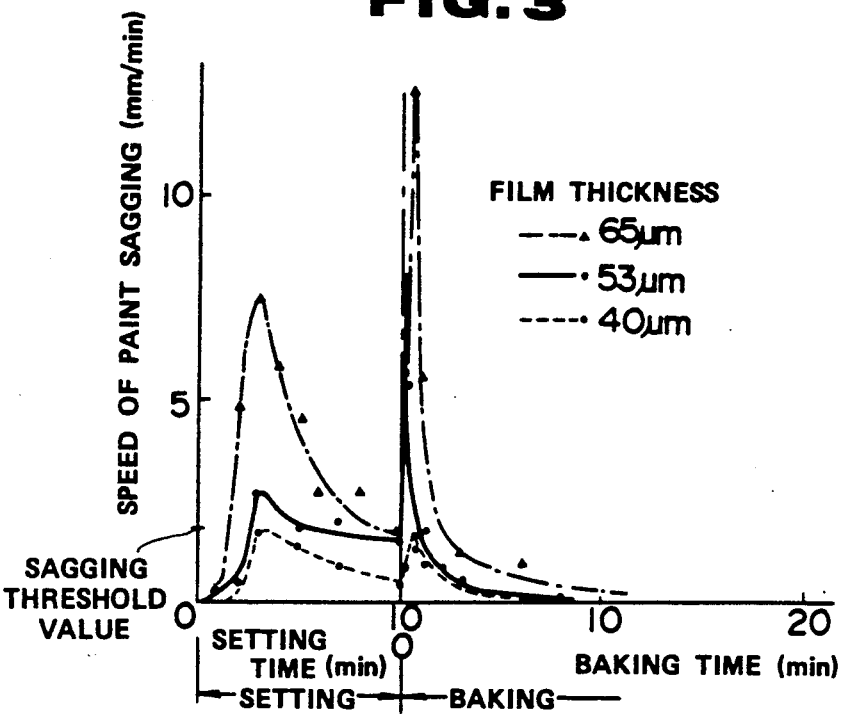
FIG. 3 is a graph showing the relationship of the setting and baking times vs. speeds at which the paint sags.

FIG. 3 demonstrates the influence of film thicknesses of a paint upon the speed at which the paint sags. The speeds of paint sagging are measured for three different film thicknesses of 40 μm, 53 μm, and 65 μm. As shown in FIG. 3, it has been found that a peak of the sagging speed appears at initial stages of the setting and baking steps in each case.

It should be noted that the term "sagging limit thickness" or related terms means a value that the paint coated on the body moves by 1 to 2 mm during the drying step as have been described hereinabove. More specifically, the term is intended to mean a limit of a film thickness in which a mark or scar is visually recognized after the drying step as a result of the paint having moved by 1 to 2 mm on the coat surface from the position where the paint was coated. For conventional paints, the maximum film thickness obtainable within the sagging limit thickness are in the range from approximately 35 to 40 μm.

Relationship of Film Thickness with Degree of Flatness

Figure 4:
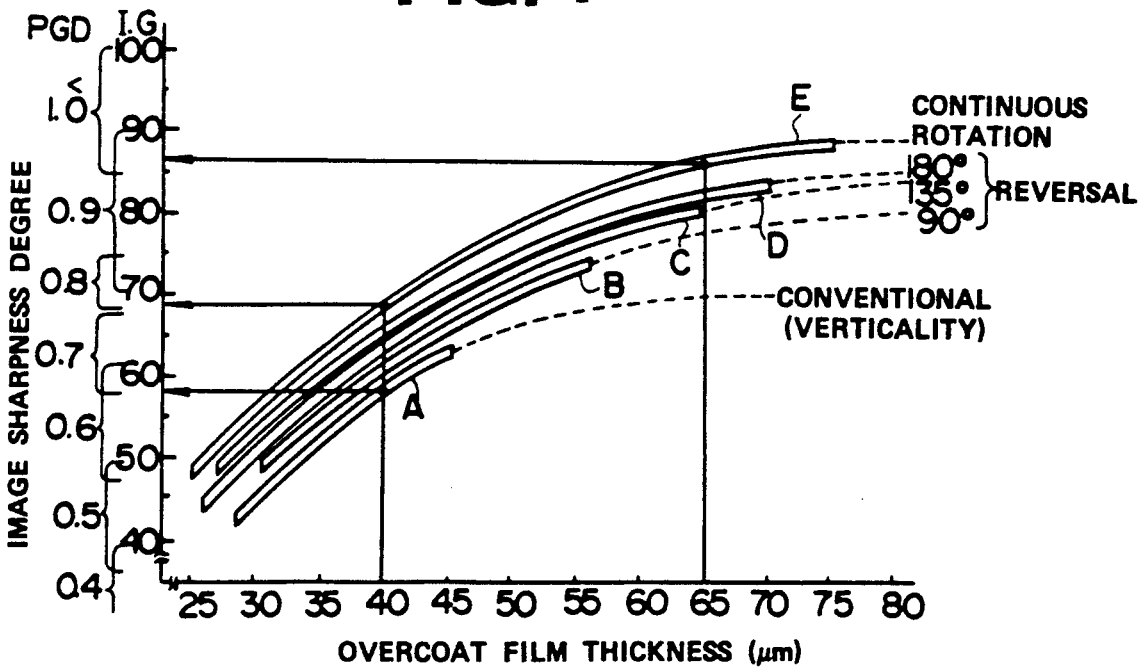
FIG. 4 is a graph showing the relationship of film thicknesses of the paint vs. degrees of image gross.

FIG. 4 shows the influence of the rotation of the vehicle body W about its horizontal axis upon degrees of flatness on the coat surface of the substrate expressed in a degree of image gross.

In FIG. 4, reference symbol A denotes a state of the coat surface obtained without the rotation of the vehicle body W in conventional manner. Reference symbol B denotes a state of the coat surface obtained by the rotation of the body W which is carried out in a clockwise direction at the angle of 90 degree, namely, from the position of FIG. 2(*a*) through FIG. 2(*b*) to FIG. 2(*c*) and then reversed in the opposite direction back to the original position of FIG. 2(*a*) from which, namely, from FIG. 2(*i*), the body W in turn is continued to be rotated in the same direction through FIG. 2(*h*) to FIG. 2(*g*) and then turned again in the counterclockwise direction therefrom through FIG. 2(*h*) to the original position of FIG. 2(*i*). Reference symbol C demonstrates a state of the coat obtained when the rotation of the body W is carried out first in a clockwise direction at the angle of 135 degrees, namely, from the original position of FIG. 2(*a*) through FIGS. 2(*b*) and (*c*) to FIG. 2(*d*) and reversed in a counterclockwise direction therefrom through FIGS. 2(*c*), (*b*) to FIG. 2(*a*) from which, namely, from FIG. 2(*i*), the rotation is continued to FIG. 2(*h*) and then reversed again in a clockwise direction to the original position of FIG. 2. Reference symbol D demonstrates a state of the surface of the coat which was obtained by the rotation of the body W at the angle of 180 degrees in a clockwise direction from the position of FIGS. 2(*a*) to (*e*) and then by reversal of the rotation in a counterclockwise direction back to the original position of FIG. 2(*a*). In FIG. 4, reference symbol E shows a state of the coat surface obtained when the body W is continuously rotated around in one way from the original position of FIG. 2(*a*) through FIGS. 2(*b*), (*c*), (*d*), (*e*), (*f*), (*g*), and (*h*) to the original position of FIG. 2(*i*), namely, FIG. 2(*a*).

As shown in FIG. 4, it is found that higher degrees of flatness on the coat surfaces are given when the body W is rotated as in the cases of reference symbols B, C, D and E, than reference symbol A, if the film thicknesses are the same. It is also found that a higher degree of flatness can be produced when the body W is rotated continuously in one direction at the angle of 360 degrees than when the rotation is carried out in one direction and then reversed in the opposite direction or directions. It is further found in the result shown in FIG. 4 that the coat obtainable without rotation of the body W is thin in a film thickness, thus leading to a lower degree of flatness and producing a limit upon thickening its film thickness.

To determine the degree of smoothness or flatness on a coated surface, an image sharpness degree is used which assigns a mirror surface on a black glass an I.G. (image gloss) score of 100. By comparison, a film thickness of 65 μm formed by rotating the vehicle body W at the angle of 360 degrees, gets an 87 on the I.G. scale (the lower limit at a PGD value being 1.0), which means that the coated surface has 85% of the I.G. score for the mirror surface of the black glass. A film thickness of 40 μm scores a 58 (the lower limit at a PGD value being 0.7) when formed without rotation of the vehicle body W and a 68 (the lower limit at a PGD value being 0.8) when formed by rotating it at 360 degrees. In the above definition, PGD values stand for a degree of identification of a reflected image and is rated so as to be decreased from 1.0 as the degree of smoothness gets lower.

The data shown in FIGS. 3 and 4 were obtained by overcoating in the spraying step P2 above under following test conditions:

(a) Paint: melamine alkyd (black).
  Viscosity: 22 seconds/20° C. (measured by Ford Cup #4)
(b) Film coater: Minibell (16,000 r.p.m.).
  Shaping air: (2.0 kg/cm$^2$ c).
(c) Spraying amounts: sprayed two times:
  First time: 100 cc/minute
  Second time: 150–200 cc/minute
(d) Setting time/temperature: 10 minutes/room temperature
(e) Baking temperature/time: 140° C./25 minutes
(f) Degree of flatness on overcoat surface:
  0.6 (PGD) (intercoating on PE tape)
(g) Time period for rotation and reversal:
  10 minutes (for the setting step)
  10 minutes (for the baking step)
(h) Coating Substrate:
  The side surfaces of a square pipe with a 30 cm side are coated and supported rotatably at its center.

(i) Rotational speeds:
6, 30, and 60 r.p.m.

It is found that there is no variation in degrees of flatness on the coat surfaces obtained by the different speeds of rotation.

It is noted that the paint used as shown in FIG. 3 is likely to start sagging within one minute at the time of the start of the setting step, i.e., at the time of completion of the coating, when the paint is coated in the film thickness of 65 μm. Accordingly, if the paint is used in the film thickness as thick as 65 μm, no problem is caused when the rotation of the body starts soon after the completion of the spraying, however, the risk is incurred that the paint sags while the body is transferred to the setting step P3 from the spraying step P2 if the time required for transferal takes longer than 1 minute.

Swelled Mass of Paint

Figure 30:
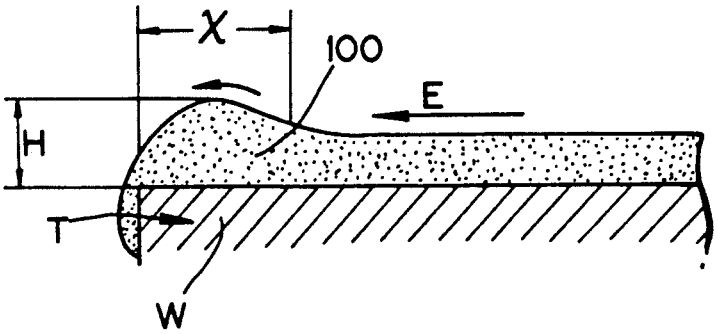

Referring to FIG. 30, it has been found as a result of experiments that a formation of a swell mass of the paint on an edge portion of the substrate relates closely to the kind and a film thickness of a paint and that, assuming that the kind and the film thickness of the paint are constant, a thickness H and a width X of the swell mass of the paint become substantially constant.

TABLE 1

| Coating Method | Thickness of Coat (μm) | Thickness of Swelled Mass (μm) | Width of Swelled Mass (μm) | Appearance |
|---|---|---|---|---|
| Conventional Method | 40–50 | 80–120 | 2 | Good |
| Present Invention | 60–70 | 300–400 | 4–5 | Not Good |
| | 70 | " | 6–8 | Not Good |

It is to be noted that the thickness of the coat and the thickness and width of the swelled mass are on the dry basis.

As a result of the experiments as shown above, it has been found that the method according to the present invention may form a mass of the paint swelled on an edge portion of the substrate without previously processing the substrate or spraying in such a modified manner as have been described above. Accordingly, as will be apparent from the experimental results, it is found sufficient to provide an edge portion of the substrate where the paint swells as a mass 100 when cured with a difference in level on the surface of the substrate to such an extent that its depth is as low as approximately 0.5 mm or lower and its width is as long as 5 mm or shorter, in order to make such swelled mass little or less noticeably.

Relationship of Appearance with Difference in Level on Surface of Substrate

Figure 17:
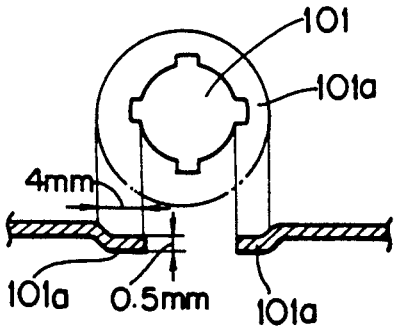
FIG. 17 is a sectional view taken along the line X17—X17 of FIG. 16, showing a hole for mounting a window washer formed on the bonnet in an enlarged manner.
Figure 18:
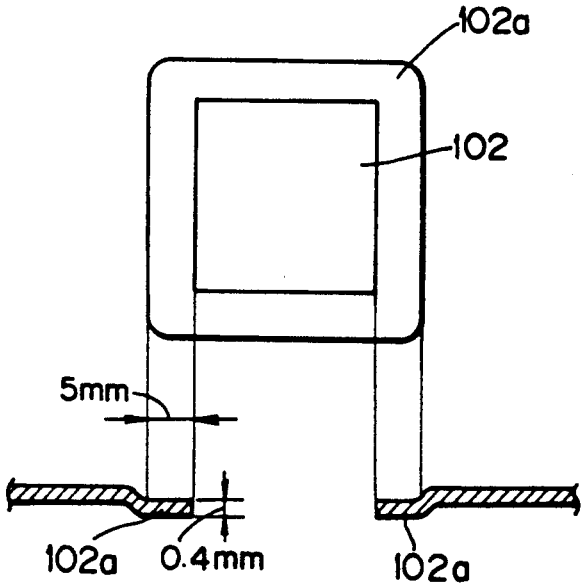
FIG. 18 is a sectional view taken along the line X18—X18 of FIG. 16, showing a hole for mounting an ornament formed on the bonnet in an enlarged manner.

As shown in FIG. 17, a hole 101 for mounting a window washer nozzle of the bonnet W is provided with a concave difference 101*a* in level around its circumferential opening end portion in a depth of 0.5 mm and a width of 4 mm. As shown in FIG. 18, a hole 102 for mounting an ornament of the bonnet W is provided with a concave difference 102*a* in level around its circumferential opening end portion in a depth of 0.4 mm and a width of 4 mm.

Experiments have been made by spraying the paint in a film thickness thicker than its sagging limit thickness under the following experimental conditions:

1. Substrate Treatment
   Cationic electrodeposition: 20 μm; baked at 175° C. for 30 minutes
   Intercoting: 40 μm; baked at 140° C. for 25 minutes (polyester paint of a thermosetting and oil-free type; gray)
   Wet rubbing for intercoating: water-resistant paper #800
2. Overcoating Conditions:
   Overcoating: thermosetting melamine alkyd paint; black; sprayed in a viscosity of 22 seconds when measured by means of Ford Cup #4 at 20° C.
   Coater:
   Minibell (bell size: 60 mm), 22,000 r.p.m.; voltage: −90 kv
   shaping air force: 3.0 kg/cm$^2$
   distance from spray gun: 30 cm Position of spraying: sprayed on a surface of the bonnet set in a horizontal position.

Number of stages: two stages (in the interval of three minutes).

Booth circumstance: ambient temperature, 20° C.; air velocity: 0.2 meter per second.

Baking: 10 minutes after setting; 140° C. for 25 minutes. (rate of elevation from 20° C. to 140° C.: 15° C. per minute).

Film thickness: 40, 50, 60, 70 and 80 μm (dry).

The experimental results are shown in Tables 2 and 3 below, in which conventional structure means that a mountng hole is provided with no difference in level around its circumferential end portion.

Table 2 below shows the experimental results for the thickness and width of a swelled mass of the paint as well as an appearance of the coat when the hole 101 for mounting the window washer nozzle was coated under the above coating conditions.

TABLE 2

| Film | Conventional Structure | | | Present Invention | | |
|---|---|---|---|---|---|---|
| Thickness (μm) | Thickness (μm) | Width (μm) | Appearance | Thickness (μm) | Width (μm) | Appearance |
| 40 | 85 | 1.6 | Good | 82 | 1.4 | Good |
| 50 | 110 | 2.0 | Good | 114 | 1.8 | Good |
| 60 | 275 | 3.5–4.1 | Not Good | 360 | 4.0 | Good |
| 70 | 330 | 4.3–4.7 | Not Good | 430 | 4.0 | Good |
| 80 | 365 | 6.4–7.7 | Not Good | 520 | 4.1 | Good |

It is to be noted that the film thickness of the coat as well as the thickness and the width of the swelled mass of the paint were measured on the dry basis.

For the hole 102 for mounting the ornament, the same experimental results as the hole 101 above are shown in Table 3 below.

TABLE 3

| Film | Conventional Structure | | | Present Invention | | |
|---|---|---|---|---|---|---|
| Thickness (μm) | Thickness (μm) | Width (μm) | Appearance | Thickness (μm) | Width (μm) | Appearance |
| 40 | 76–105 | 1.2–1.8 | Good | 78–90 | 1.4 | Good |
| 50 | 110–118 | 1.6–2.0 | Good | 108–122 | 2.0 | Good |
| 60 | 260–290 | 3.5–4.6 | Not Good | 255–280 | 4.3 | Good |
| 70 | 305–340 | 4.0–5.4 | Not Good | 310–335 | 5.0 | Good |
| 80 | 355– | 6.2– | Not Good | 400– | 5.4 | Good |

TABLE 3-continued

| Film Thickness (μm) | Conventional Structure Thickness (μm) | Width (μm) | Appearance | Present Invention Thickness (μm) | Width (μm) | Appearance |
|---|---|---|---|---|---|---|
| | 370 | 8.1 | | 550 | | |

It is noted that the film thickness of the coat as well as the thickness and the width of the swelled mass of the paint were measured on the dry basis.

As is apparent from the results shown in Tables 3 and 4, a swelled mass of the paint on the edge portions of the substrate can be made less noticeably when the difference in level is provided on the circumferential edge portions of the mounting holes 101 and 102.

Alternative Examples (FIGS. 19–27)

The following examples are directed to features in which the coating is deviced by coating an edge portion of the substrate in a film thickness thinner than the other portions thereof prior to the spraying of the paint in a film thickness thicker than its sagging limit thickness in order to prevent a formation of a swelled mass of the paint on the edge portion thereof.

The film thickness of the coat on the edge portion of the substrate may be thinned in several ways.

Figure 19:
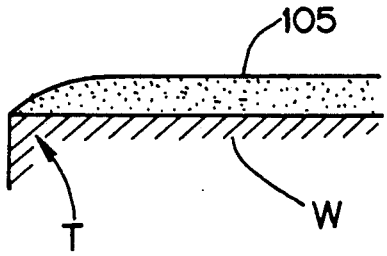
FIG. 19 is a sectional view showing a coat formed by the first stage of sprayings.

A first alternative example involves spraying a surface of the substrate W with a paint by means of a spray gun or guns in such a manner that the spray gun or guns does or do not come closer to the edge portion T. This spraying permits forming a coat 105 on the surface of the body W so as to make a coat 105 on the edge portion T thinner than that on the other portion, as shown in FIG. 19.

Figure 20:
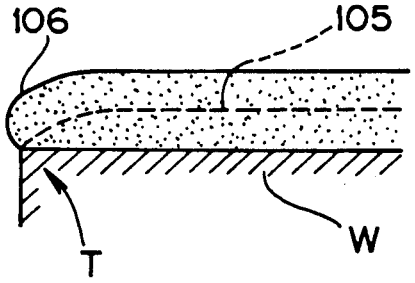
FIG. 20 is a sectional view showing a state of the coat formed immediately after the second stage of sprayings.
Figure 21:
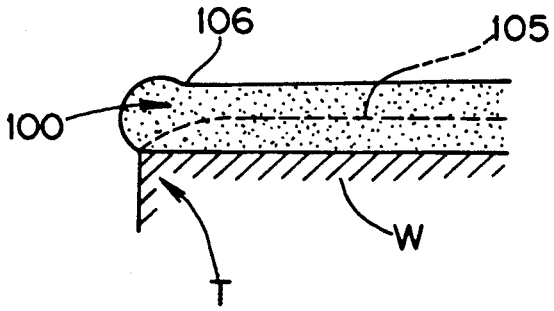
FIG. 21 is a schematically sectional view showing a state of a swell mass of the paint formed on an edge portion of the substrate after completion of the second stage of sprayings.

Then the paint is sprayed on the coat 105 in a film thickness so as to form a coat 106 having a film thickness exceeding the thickness at which the paint sags, as shown in FIG. 20. The coat 106 is cured, however, a mass of the paint swelled on the edge portion is not formed or is so small that a film thickness of the coat 100 around the edge portion is substantially the same as that on the other portions, as shown in FIG. 21. Even if a mass of the paint would swell on the edge portion of the substrate, it does not present any problem with appearance.

Figure 22:
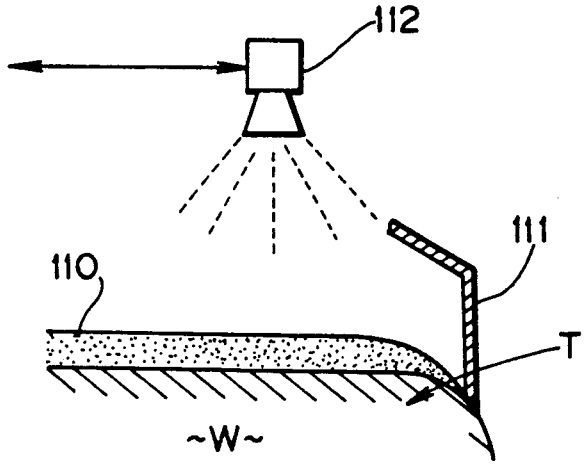
FIG. 22 is a schematically sectional view showing a state of the coat which is sprayed with an intermediate paint or an intercoating paint with a masking disposed.

FIG. 22 shows a second alternative technique for spraying the paint on an edge portion of the substrate in a film thickness thinner than that on the other portions thereof. As shown in FIG. 22, a masking 111 is disposed so as to touch a surface of the body W as a substrate along its substantially upward body line and to reach a position higher than its substantially transverse body surface. The masking 111 is further curved at its upper portion so to cover the edge portion T of the body W. With the masking 111 disposed on the substrate in the manner as have been described hereinabove, the paint is sprayed onto the substrate through the spray gun 112 by displacing the gun 112 in the leftward-to-rightward direction or vice versa as indicated by the arrow in FIG. 22, thereby forming a coat 110 on the surface of the substrate W. In this feature, when the spray gun 112 comes closer to the edge portion T, the paint sprayed therefrom is blocked by the masking 112, thereby making a film thickness of the coat 110 on the edge portion T thinner than that on the other portions. It is said that the coat 110 is formed in substantially the same manner as the coat 105 of FIG. 19. It is further preferred that the masking 111 is made out of a material which is likely to adsorb the paint in order to prevent the paint adhered to the masking 111 from dripping onto the edge portion T of the substrate.

Figure 23A:
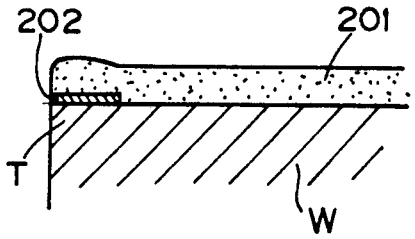
FIG. 23A is a schematically sectional view showing another example of masking.
Figure 23B:
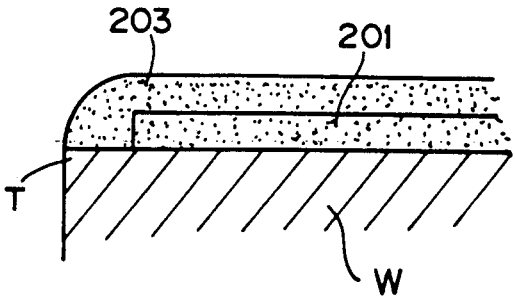
FIG. 23B is a schematically sectional view showing a state of the coat formed by coating the paint in a film thickness thicker than its sagging limit thickness on the coat treated previously by means of masking processing for the coat of FIG. 23A.

As shown in FIG. 23A, a third alternative example is such that a thin masking 202 may be disposed on an edge portion T of the substrate W in order to have no paint coated directly thereon and to spray the paint on the masking 202 from a spray gun (not shown), thus forming a coat 201 thereon. After completion of the spraying, the masking 202 is removed while leaving the edge portion T unsprayed, and the substrate is then sprayed with the paint in a film thickness thicker than its sagging limit thickness to form a coat 203, as shown in FIG. 23B. This technique can prevent the paint from swelling on the edge portion.

Figure 24A:
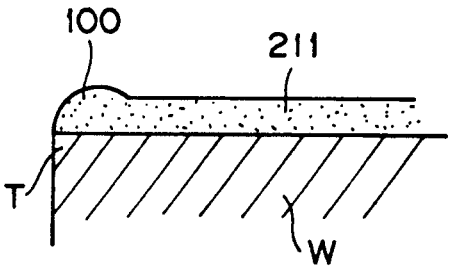
FIGS. 24A and 24B are schematically sectional views showing a state of the coat which is treated with a sand paper to lower its edge portion.
Figure 24B:
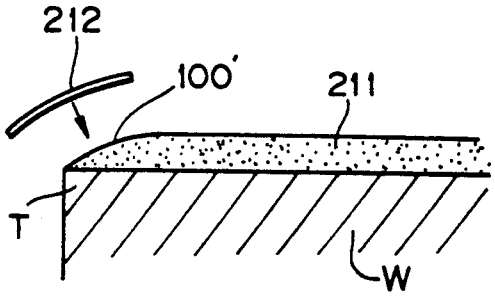

FIG. 24A shows a fourth alternative technique which involves rubbing a swelled mass 100 of the cured coat 211 on an edge portion T of the substrate with a sandpaper 212 after the edge portion T thereof was sprayed with the paint in a film thickness as thick as on the other portions thereof and cured as in a conventional manner, thereby making a film thickness of the coat 100' thinner than the film thickness of the coat 100 on the other portions thereof, as shown in FIG. 24B. This technique requires operation of rubbing the coat with a sandpaper, however, it offers the advantage that the paint can be sprayed on the substrate without paying any attention to the fact that a film thickness of the coat 211 on the edge portion thereof should be made thinner than on the other portions. This is also advantageous that the coat 211 is formed in a film thickness thicker than a sagging limit thickness of the paint. It is to be noted that the coat 211 as shown in FIG. 24B is substantially the same as the coat 105 as shown in FIG. 19. The rubbing may be effected with a means such as a rubstone or a compound, in addition to the sandpaper 212.

Figure 25:
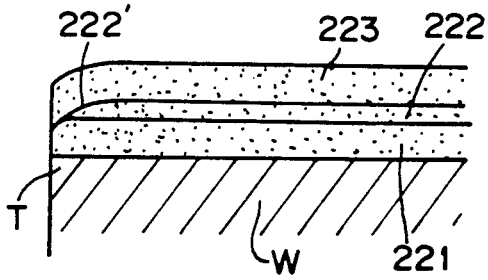
FIGS. 25 and 26 are each a schematically sectional view showing another example for forming the coat in a film thickness thicker than its sagging limit thickness by means of two stages of sprayings.
Figure 26:
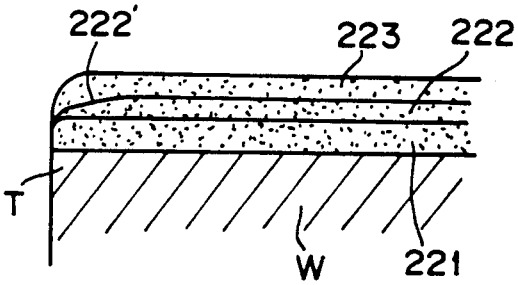

The paint may be sprayed once or more in accordance with the kind of coat processing as long as there is eventually given a desired film thickness thicker than the thickness at which the paint sags. For instance, as shown in FIG. 25, when the paint is sprayed in a film thickness thicker than its sagging limit thickness, the first spraying may be effected to form a coat in a film thickness thinner than its sagging limit thickness and the second spraying may be conducted so as to give a coat having a film thickness exceeding its sagging limit thickness. Referring to FIG. 25, an overcoating paint is sprayed in a film thickness within its sagging limit thickness on a coat 221 of an intercoating paint after the coat 221 has been cured, forming a first overcoat 222 which, in turn, is sprayed with the overcoating paint in a film thickness exceeding its sagging limit thickness on the first overcoat 222 to give a second overcoat 223, while the overcoat 222 is still wet, i.e., before it has been cured. As an alternative technique, the first and second sprayings with the paint may be effected in each case in a film thickness thinner than its sagging limit thickness, then totaling the film thickness thicker than the thickness at which the paint sags, as shown in FIG. 26. In this instance, the paint is sprayed on a cured intercoat 221 in a film thickness thinner than its sagging limit thickness, forming a first overcoat 222 and the paint is further sprayed on the wet first overcoat 222 in a film thickness thinner than its sagging limit thickness to form a second overcoat 223, whereby a combined film thickness of the coats 222 and 223 exceeds a film thickness thicker than its sagging limit thickness.

In the cases as shown in FIGS. 25 and 26, a film thickness of the first overcoat 222 on an edge portion T of the vehicle body W is thinner than that on the other portions thereof, thereby preventing a mass of the paint from swelling on the edge portion thereof. In this instance, it is also possible to spray the edge portion T of the body W with the intercoating paint in a film thickness thinner than the other portions thereof and then with the overcoating paint on the edge portion T so as to form the first overcoat 222 in a film thickness substantially equal to the other portions thereof.

It will be understood from the foregoing description that there may be conveniently employed the technique of making a film thickness of the coat on the edge portion T of the body W thinner than that on the other portions thereof and the technique of spraying the paint on the body W so as to form a final film thickness thicker than its sagging limit thickness. It is further understood that which coat should be thinner than the other coat or coats can be appropriately selected in a combination with the above-mentioned techniques.

The coating method according to the present invention will be further described by way of experiments.

Figure 27:
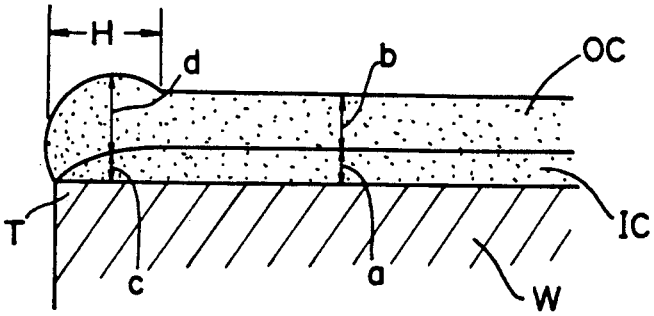
FIG. 27 is a schematically sectional view showing dimensional positions to be indicated in Tables 4 to 6 below.
Figure 28:
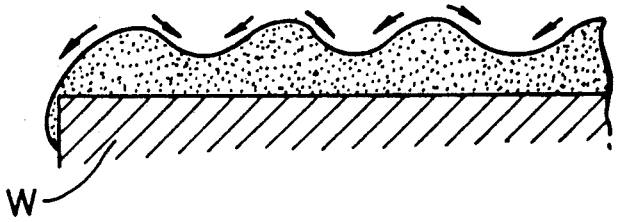
FIGS. 28 to 30 are schematically sectional view showing a mechanism of forming a swelled mass of the paint on the edge portion of the substrate in order to point out the problem encountered with conventional methods.
Figure 29:
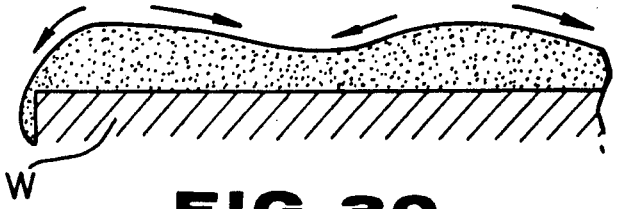

Referring to FIG. 27, a surface of an undercoat (not shown) on the body W is sprayed with the intercoating paint to form an intercoat IC on which the overcoating paint is then sprayed to form an overcoat OC which, in turn, is measured for dimensions of portions a to d of a swelled mass of the paint formed on the edge portion T thereof, a width thereof, and its appearance. The dimensions c and d are at top positions of the swelled mass thereof. Experiments have been conducted using three different types of paints, a thermosetting paint (solvent-containing paint), a two-component reactive paint, and a powder paint.

The intercoat IC and the overcoat OC have been formed in following five ways in the experiments.

I. The intercoat IC has been formed by spraying the body W with the intercoating paint in a film thickness thinner than its sagging limit thickness so as to allow the film thickness on the edge portion T to become thinner than that on the other portions thereof. The overcoat OC has been formed from the overcoating paint which was sprayed once in a film thickness thicker than its sagging limit thickness. This way of spraying corresponds to the cases as shown in FIGS. 19 to 21.

II. The intercoat IC has been formed by spraying the body W with the intercoating paint within its sagging limit thickness and the intercoat IC on the edge portion T of the body W was removed. The overcoating paint has been sprayed once on the body W in a film thickness thicker than its sagging limit thickness to form the overcoat OC. This way of spraying corresponds to the case as shown in FIGS. 23A and 23B.

III. The intercoating paint was sprayed in a film thickness beyond its sagging limit thickness on the body W including its edge portion T, thereby forming the intercoat IC on its edge portion T in a film thickness substantially equal to those on the other portions thereof. After it has been cured, then the intercoat IC on the edge portion T thereof was rubbed so as to become thinner than on its other portions. Thereafter, the overcoating pint was sprayed once so as to become thicker than its sagging limit thickness, as shown in FIGS. 24A and 24B as well as in FIGS. 20 and 21.

IV. The overcoating paint was sprayed on the edge portion T of the substrate W in a film thickness within its sagging limit thickness in an equal manner as on the other portions thereof, thereby forming the intercoat IC. After the intercoat IC was cured, the overcoating paint was sprayed twice, the first overcoating being effected in such a manner that a film thickness was thinner than the thickness at which the paint sags and that the film thickness on the edge portion T thereof became thinner than those on the other portions thereof, and the second overcoating being effected, while the first overcoat OC was still wet, so as to become thicker than its sagging limit thickness. This way of forming the coats corresponds to the case as shown in FIG. 25.

V. The intercoat IC has been formed in the same way as in the way IV above. The overcoating was effected in substantially the same manner as in the way IV above, with the exception that the second overcoating was effected to give a second overcoat in a film thickness thinner than yet becoming thicker than its sagging limit thickness. This way corresponds to the case as shown in FIG. 26.

The experimental results are shown in Tables 4 to 6 below, in which Table 4 is directed to the experiments using the thermosetting paint, Table 5 to those using the two-liquid type paint, and Table 6 to those using the powder paint. In the tables below, italics under the column "Ways" correspond to the ways of forming the intercoat IC and the overcoat OC, as have been described hereinabove, as well as the the terms "CM" under the column 'Method' is intended to mean "conventional method" which involves spraying the paint without processing the film thickness of the coat on the edge portion T of the body W so as to become thinner than those on the other portions thereof and the terms "PI" is intended to mean "present invention". The evaluation for appearance is determined on the basis of a value of the dimensions a to d obtained by the following formula:

$$(c+d)-(a+b)$$

Then the appearance was evaluated as "Good" when the value of the above formula is 150 μm or smaller while the appearance was evaluated as "NG" (Not Good) when the value thereof is larger than 150 μm. The conditions for the experiments will be described below.

TABLE 4

| | | Thermosetting Paint | | | | | |
|---|---|---|---|---|---|---|---|
| | | Dimensions (μm) | | | | Width, | Appea- |
| Ways | Method | a | b | c | d | μm | rance |
| I | CM | 50 | 70 | 80 | 300–400 | 6–8 | NG |
| | PI | 50 | 70 | 30 | 100–200 | 4 | Good |
| II | CM | 50 | 70 | 80 | 300–400 | 6–8 | NG |
| | PI | 50 | 70 | 0 | 150–200 | 3–4 | Good |
| III | CM | 70 | 70 | 100 | 350–450 | 7–8 | NG |
| | PI | 70 | 70 | 50 | 150–250 | 4 | Good |
| VI | CM | 40 | 70 | 70 | 250–350 | 5–7 | NG |
| | PI | 40 | 70 | 30 | 100–200 | 4 | Good |
| V | CM | 40 | 40 | 70 | 200–300 | 5–7 | NG |
| | PI | 40 | 40 | 30 | 50–150 | 3–4 | Good |

TABLE 5

| | | Two-Liquid Type Paint | | | | | |
|---|---|---|---|---|---|---|---|
| | | Dimensions (μm) | | | | Width, | Appea- |
| Ways | Method | a | b | c | d | μm | rance |
| I | CM | 50 | 70 | 90 | 350–450 | 7–8 | NG |
| | PI | 50 | 70 | 30 | 150–230 | 4–4.5 | Good |
| II | CM | 50 | 70 | 90 | 350–450 | 7–8 | NG |

TABLE 5-continued

| Ways | Method | Two-Liquid Type Paint Dimensions (μm) a | b | c | d | Width, μm | Appearance |
|---|---|---|---|---|---|---|---|
| | PI | 50 | 70 | 0 | 180–250 | 4 | Good |
| III | CM | 70 | 70 | 110 | 380–500 | 8–9 | NG |
| | PI | 70 | 70 | 30 | 180–250 | 4–4.5 | Good |
| VI | CM | 40 | 70 | 80 | 280–380 | 6–7 | NG |
| | PI | 40 | 70 | 30 | 150–220 | 4–4.5 | Good |
| V | CM | 40 | 40 | 70 | 230–330 | 6–7 | NG |
| | PI | 40 | 40 | 30 | 80–190 | 4 | Good |

TABLE 6

| Ways | Method | Powder Paint Dimensions (μm) a | b | c | d | Width, μm | Appearance |
|---|---|---|---|---|---|---|---|
| I | CM | 100 | 150 | 120 | 290–350 | 5–6 | NG |
| | PI | 100 | 150 | 60 | 150–230 | 3–4 | Good |
| II | CM | 80 | 150 | 100 | 290–350 | 5–6 | NG |
| | PI | 80 | 150 | 0 | 180–260 | 3 | Good |
| III | CM | 150 | 150 | 200 | 280–380 | 6 | NG |
| | PI | 150 | 150 | 100 | 150–250 | 3–4 | Good |
| VI | CM | 90 | 150 | 115 | 280–380 | 5 | NG |
| | PI | 90 | 150 | 50 | 150–250 | 3–4 | Good |
| V | CM | 100 | 100 | 130 | 230–330 | 5 | NG |
| | PI | 100 | 100 | 70 | 100–150 | 3 | Good |

The following are details of the paints used for the above experiments and the conditions for spraying the paints in the above experiments.

A. Thermosetting Paint (a) Intercoating:

Paint:

Thermosetting-type, oil-free, polyester paint; gray

Viscosity for spraying: 22 seconds; Ford Cup #4, 20° C.

Coater:

Minibell (bell size: 60 mm)

Number of revolutions: 22,000 rpm

Voltage: −90 kv

Shaping air pressure: 3.0 kg/cm$^2$

Distance from gun: 30 cm

Setting: 10 minutes at room temperature

Baking: 140° C. for 25 minutes (b) Overcoating:

Paint:

Melamine alkyd high-solid theremosetting-type paint (main resinous component: average molecular weight, 2,800; color: black)

Viscosity for spraying: 20 seconds; Ford Cup #4, 20° C.

Non-volatilizable components: 48% by weight

Solvents:

Toluene, 25 parts by weight;

Solvesso 100, 25 parts by weight;

Solvesso 150, 50 parts by weight

Agent for preventing sags: cross-linked acrylic resin powder, 3% by weight based on the weight of the non-volatilizable components Coater:

Minibell (bell size: 60 mm; Nippon Lundsberg, K. K.)

Number of revolutions: 1,600 rpm

Voltage: 90 kv

Shaping air pressure: 3.0 kg/cm$^2$

Distance from gun: 30 cm

Spraying: two-stages in the interval of 5 minutes

Atomosphere: 20° C.±2° C.

Air velocity in booth: 0.3±0.1 m/second (push-and-pull down flow)

Setting: 20° C.±2° C. for 10 minutes

Baking:

140° C. for 25 minutes

Rate of elevating: 8 minutes (from 20° C. to 140° C.)

Rotating: Rotating the body W about its horizontal axis away by 75 cm from the central axis thereof so as to allow its both side surfaces parallel to each other at the speed of 6 rpm.

B. Two-Liquid Type Paint (a) Intercoating:

Paint:

Polyester urethane paint; gray ("P-026"; Nippon Bee Chemical K. K.)

Main resin: polyester polyol

Curing agent: hexamethylene diol

Admixture ratio: 4 (main resin) to 1 (curing agent)

Coater: Pressure-flow type air spray gun (Iwata Tosoki K. K.; "Wider-W71")

Spryaing viscosity: 16 seconds/Ford Cup #4, 20° C.

Shaping air pressure: 4.0 kg/cm$^2$

Distance from gun: 30 cm

Setting: 10 minutes at room temperature

Baking: 90° C. for 25 minutes (b) Overcoating:

Paint:

Polyester urethane paint; white ("P-263"; Nippon Bee Chemical K. K.)

Main resin: Polyester polyol, white

Curing agent: hexamethylene diisocyanate

Admixture Ratio: 4 (main resin) to 1 (curing agent)

Coater: Pressure-flow type air spray gun (Iwata Tosoki K. K.; "Wider-W71)

Viscosity for spraying: 16 seconds; Ford Cup #4, 20° C.

Shaping air pressure: 4.0 kg/cm$^2$

Distance from gun: 30 cm

Spraying: two-stages in the interval of 5 minutes

Setting: room temperature for 10 minutes

Baking: 90° C. for 25 minutes Rate of elevating: 5 minutes (from 20° C. to 90° C.)

Rotating: the same as the thermosetting paint

C. Powder Paint (a) Intercoating:

Paint: Epoxy powder paint; gray ("Powdax E"; Nippon Paint K. K.)

Coater: Electrostatic powder coater ("GX 101"; Onoda Cement K. K.)

Pressure: −60 kv

Amount of atomizing paint: 180 grams per minute

Paint conveying air pressure: 2.0 kg/cm$^2$

Distance from gun: 25 cm

Drying: 170° C. for 25 minutes. Elevated for 8 minutes from 20° C. to 170° C.

(b) Overcoating:

Paint: Acrylic powder paint ("Powdax A"; Nippon Paint K. K.)

Coater: Electrostatic powder coater ("GX101"; Onoda Cement K. K.)

Pressure: −60 kv

Amount of atomizing paint: 180 grams per minute

Spraying at two stages in the interval of 5 minutes

Paint conveying air pressure: 2.0 kg/cm$^2$

Distance from gun: 25 cm
Drying: 170° C. for 25 minutes
Elevated for 8 minutes from 20° C. to 170° C.
Rate of elevating: 5 minutes (from 20° C. to 170° C.)
Rotating: the same as the thermosetting paint.

Paints

The paints to be used for the coating method according to the present invention may be any paint which has been conventionally used for coating a coating substrate and may include, for example, thermosetting paints, two-component type paints, powder paints and so on. The paints may be conveniently chosen depending upon the kind of coating processes and the outside action to be applied as well as the speed of rotation. As needed, the paints may be used, for example, by adding a sagging preventive agent thereto or by diluting them with a solvent on site.

Particularly, paints to be used for coating the vehicle body W for an automobile may be ones having a number mean molecular weight ranging from about 2,000 to about 20,000 and include a solid coat of conventional type and of high solid type, a metallic base coat of conventional type and of high solid type, and a metallic clear coat of conventional type and of high solid type. The solid coat of an alkyd melamine resin of conventional type may have a number mean molecular weight ranging from about 4,000 to about 5,000 and of high solid type from about 2,000 to 3,000; the metallic base coat of an acrylic melamine resin of conventional type may have a number means molecular weight from about 15,000 to about 20,000 and of high solid type from about 2,000 to about 3,000; the metallic clear coat of an acrylic melamine resin of conventional type may have a number mean molecular weight from about 5,000 to about 6,000 and of high solid type from about 2,000 to about 3,000; and the solid coat of a urethane isocyanate resin of conventional type may have a number mean molecular weight from about 7,000 to about 10,000 and of high solid type from about 2,000 to about 3,000. The paints having a number mean molecular weight below about 2,000, on the one hand, are in many cases of the type in which they are cured by electron beams or by ultraviolet rays and they are hard and frail, when cured, leading to the shortening of durability, because their density of cross-linkage is too high. Thus such paints are inappropriate for coating exterior panels of the vehicle body. The paints having a number mean molecular weight above 20,000, on the other, are of the type in which they have a very high viscosity so that they require a large amount of a solvent to dilute. Thus high costs are required to treat the solvent discharged. A latex polymer with a number mean molecular weight over 200,000 is not appropriate because its viscossity is elevated immediately after spraying, thus adversely affecting a degree of flatness on a coating surface.

TABLE 5

| Paint | Resin | Type | Number - Average Molecular Weight |
|---|---|---|---|
| Solid Paint | Melamine Alkyd | General High Solid | 4,000–5,000 2,000–3,000 |
| Metallic Base Paint | Melamine Acrylate | General High Solid | 15,000–20,000 2,000–3,000 |
| Metallic Clear Paint | Melamine Acrylate | General High Solid | 5,000–6,000 2,000–3,000 |

TABLE 5-continued

| Paint | Resin | Type | Number - Average Molecular Weight |
|---|---|---|---|
| Solid Paint | Urethane Isocyanate | General High Solid | 7,000–10,000 2,000–3,000 |

Rotation Jig and Carriage

Description on a rotation jig and a carriage for use for the rotation of the coating substrate such as the vehicle body W will be made hereinafter in conjunction with FIGS. 5 to 15.

Rotation Jig

The vehicle body W is mounted horizontally on the carriage through a pair of rotation jigs so as to be rotatable about its axis extending horizontally in a longitudinal direction of the body W.

Figure 5:
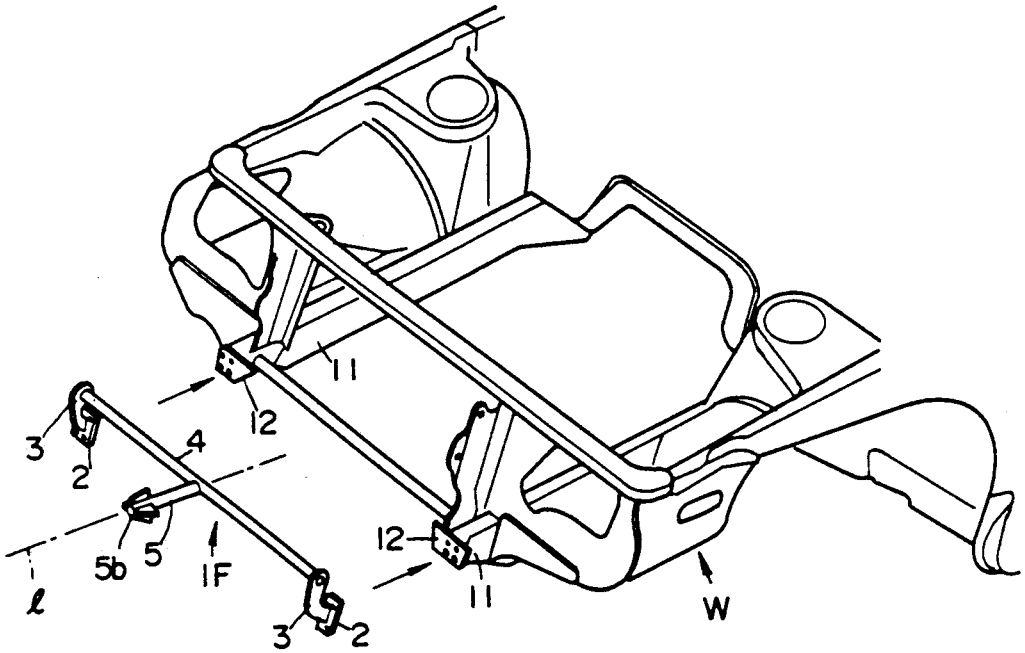
FIG. 5 is a perspective view showing a front jig for rotating the vehicle body.

FIG. 5 shows a front rotation jig 1F for horizontally supporting a forward portion of the body W. The front rotation jig 1F comprises a pair of left-hand and right-hand mounting brackets 2, a pair of left-hand and right-hand stays 3 welded to the corresponding left-hand and right-hand mounting brackets 2 and a connection bar 4 for connecting the pair of the stays 3, and a rotary shaft 5 connected integrally to the connection bar 4. The front rotation jig 1F is fixed at its portions of the brackets 2 to a forward end portion of a front reinforcing member of the vehicle body W such as a front side frame 11. To the front side frame 11 is usually welded mounting brackets 12 for mounting a bumper (not shown), and the brackets 2 are fixed with bolts (not shown) to the brackets 12 on the side of the body W.

Figure 6:
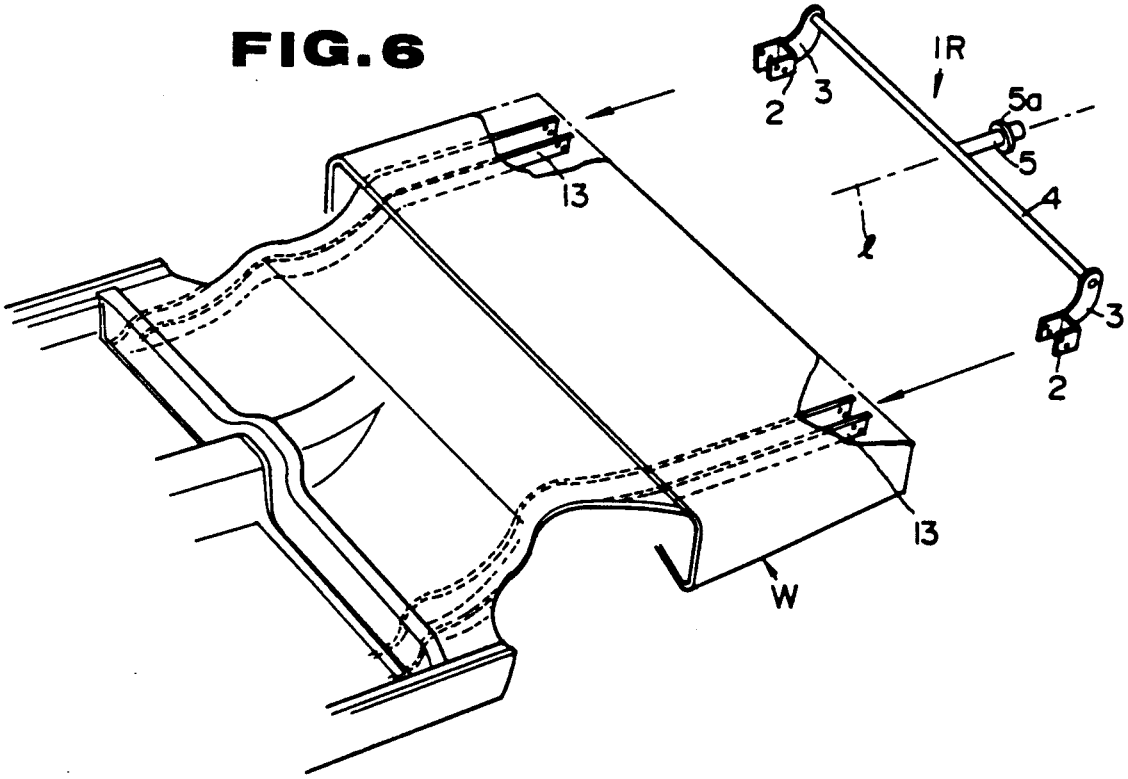
FIG. 6 is a perspective view showing a rear jig for rotating the vehicle body.

FIG. 6 shows a rear rotation jig 1R for horizontally supporting a rearward portion of the vehicle body W, which substantially the same structure as the front rotation jig 1F. In the drawing, the same elements for the rear rotation jig 1R as for the front rotation jig 1F are provided with the same reference numerals as the latter. The mounting of the rear rotation jig 1R to the vehicle body W is effected by fixing brackets 2 with bolts (not shown) to the floor frame 13 disposed at a rearward end portion of the vehicle body W as a rigidity adding member. Alternatively, the rear rotation jig 1R may be mounted to the body W through a bracket for mounting the bumper, the bracket being welded to a rearward end portion of the floor frame 13.

Figure 7:
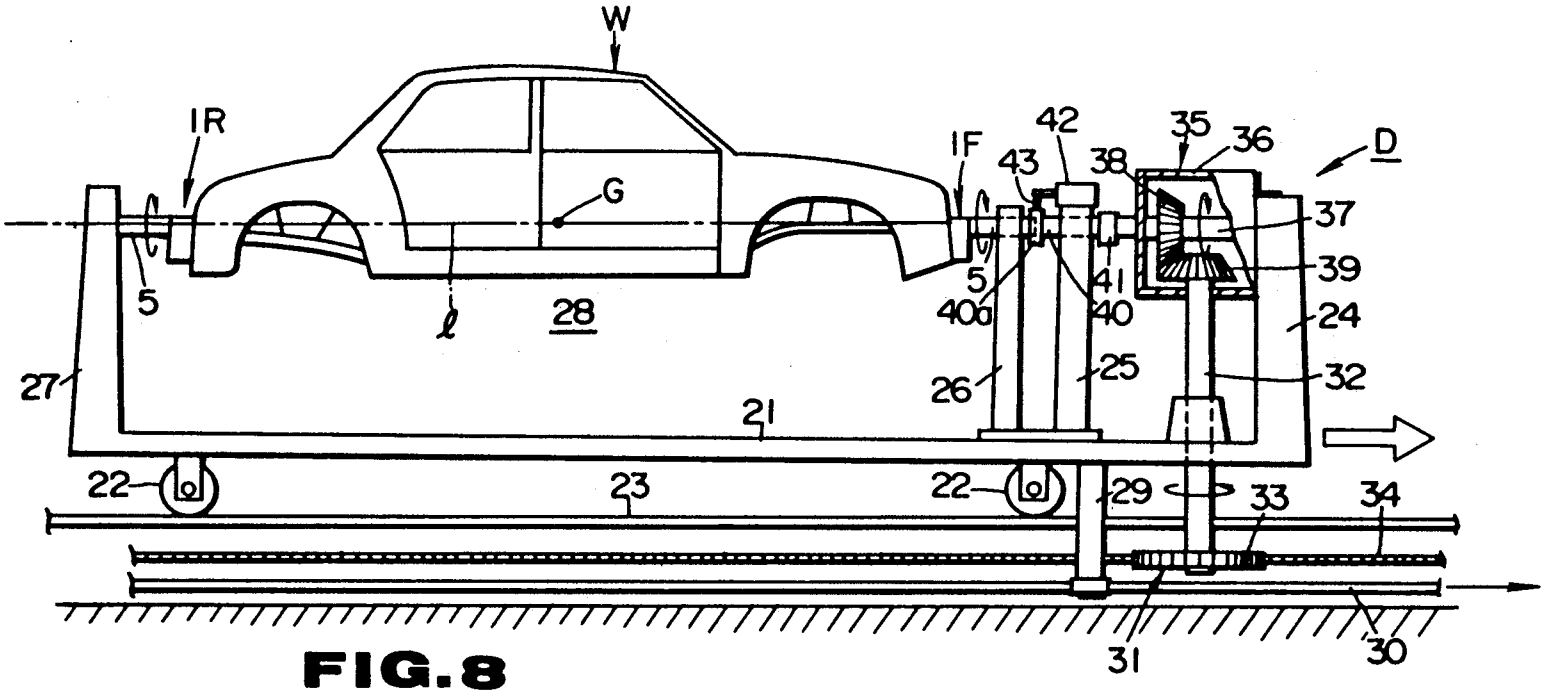
FIG. 7 is a side view showing the side portion of a vehicle-body conveying carriage for rotating the vehicle body.
Figure 9:
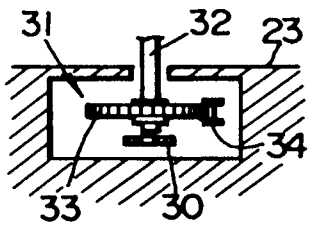
FIG. 9 is a cross-sectional view taken along line X9—X9 of FIG. 8.
Figure 8:
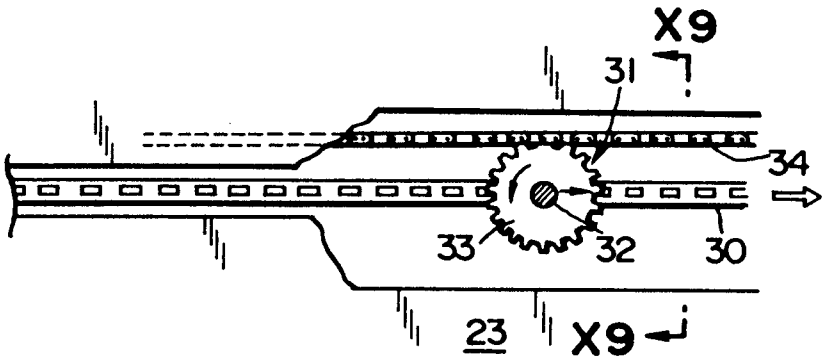
FIG. 8 is a partially cut-out plane view showing the structure of a conveying means underneath a passageway on which the carriage travels.

The front and rear rotation jigs 1F and 1R are mounted to the body W in such a manner that their respective rotary shafts 5 extend horizontally on the same straight line in its longitudinal direction when the body W is mounted on the carriage D through the front and rear rotation jigs 1F and 1R. The very straight line is the horizontal axis l about which the body W is rotated. It is preferred that the horizontal axis is designed so as to pass through the center of gravity G of the body W as shown in FIG. 7. The arrangement for the horizontal axis l to pass through the center of gravity G serves as preventing a large deviation of a speed of rotation. This can prevent an impact upon the body W accompanied with the large deviation in rotation, thus preventing the paint coated from sagging.

The front and rear rotation jigs 1F and 1R may be prepared for exclusive use with the kind of vehicle bodies.

Carriage

The carriage which will be described hereinbelow is a carriage that may be used at least during the coating step P2 and/or in the setting step P3 and that is provided with a mechanism for rotating or turning the vehicle body W about its horizontal axis l extending in a longitudinal direction thereof.

Referring to FIG. 7, the carriage D is shown to include a base 21 and wheels 22 mounted to the base 21 with the wheels 22 arranged to operatively run on rails 23. On the base 21 is mounted one front support 24, two intermediate supports 25 and 26, and one rear support 27, each standing upright from the base 21, as shown in the order from the forward side to the rearward side in a direction in which the vehicle body W is conveyed. Between the intermediate supports 25, 26 and the rear support 27 is formed a space 28 within which the body W is mounted through the front and rear rotation jigs 1F and 1R.

The vehicle body W is loaded in the space 28 and supported rotatably at its forward portion by the intermediate support 26 through the front rotation jig 1F and at its rearward portion by the rear support 27 through the rear rotation jig 1R.

Figure 10:
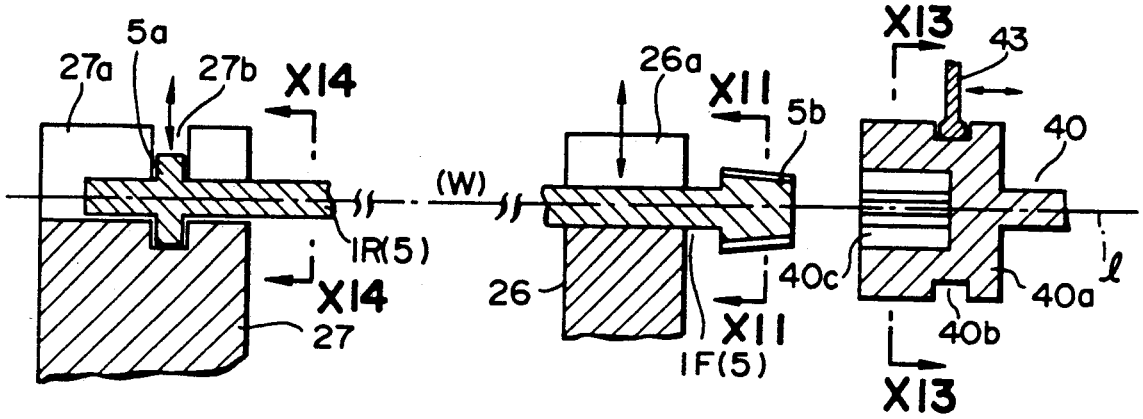
FIG. 10 is a cross-sectional side view showing a connecting portion at which the carriage is connected to a rotary jig.
Figure 11:
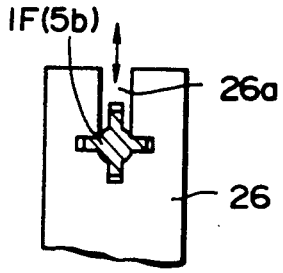
FIG. 11 is a cross-sectional view taken along line X11—X11 of FIG. 10.
Figure 12:
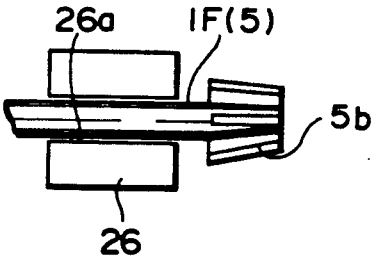
FIG. 12 is a plane view of FIG. 10.
Figure 13:
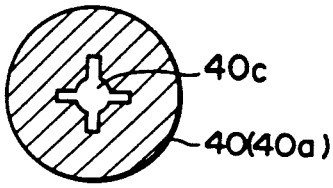
FIG. 13 is a cross-sectional view taken along line X13—X13 of FIG. 10.

As shown in FIGS. 10, 11, and 12, on the one hand, the intermediate support 26 is provided at its top surface with a groove 26*a* which in turn is designed so as to engage or disengage the rotary shaft 5 of the front rotation jig 1F with or from the support 26 in a downward direction or in an upward direction.

Figure 14:
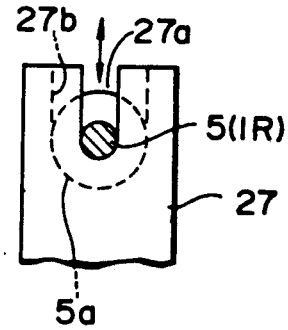
FIG. 14 is a cross-sectional view taken along line X14—X14 of FIG. 10.
Figure 15:
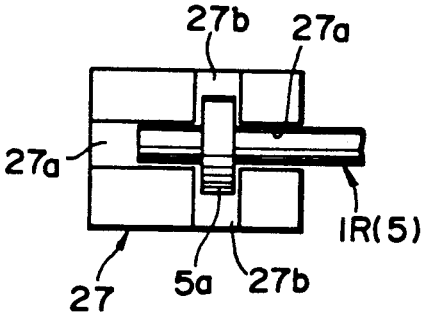
FIG. 15 is a plane view of FIG. 14.
Figure 16:
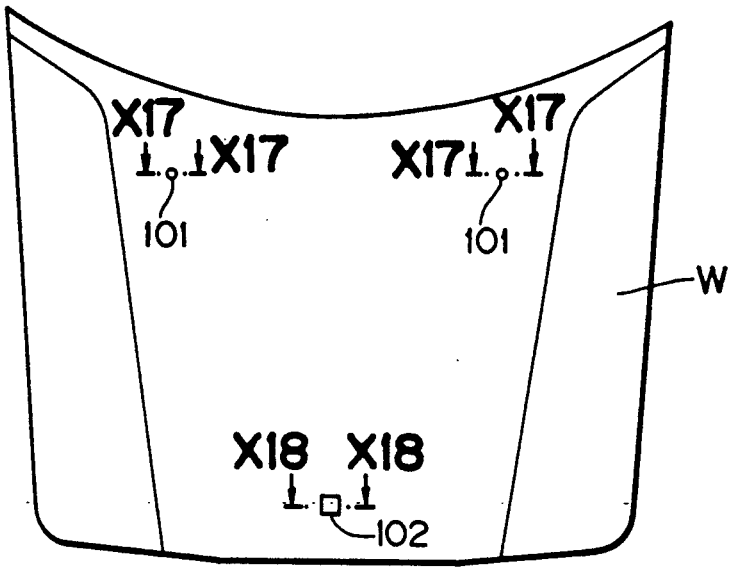
FIG. 16 is a plan view showing a surface portion of a bonnet as an exterior member of the vehicle.

As shown in FIGS. 10, 14, and 15, on the other hand, the rear support 27 is provided at its top surface with a groove 27*a* which engages or disengages the rotary shaft 5 of the rear rotation jig 1R with or from the rear support 27. The rear rotation jig 1R is further provided with a groove 27*b* in a shape corresponding to a flange portion 5*a* provided on the rotary shaft 5 of the rear rotation jig 1R, the groove being communicated with the groove 27*a*.

This arrangement permits the engagement or disengagement of the rotary shafts 5 with or from the front and rear rotation jigs 1F and 1R in a downward direction or in an upward direction, but it allows the rear rotation jig 1R to be unmovable in a longitudinal direction in which the horizontal axis extends due to a stopper action of the flange portion 5*a*.

As shown in FIGS. 10, 11, and 12, the rotary shaft 5 of the front rotation jig 1F is provided at its end portion with a connection portion 5*b* through which a force of rotation of the rotary shaft 5 of the front rotation jig 1F is applied to the vehicle body W, as will be described hereinbelow.

From the base 21 extends downwardly a stay 29 to a lower end portion of which is connected a retraction wire 30. The retraction wire 30 is of endless type and is drivable in one direction by a motor (not shown). The retraction wire 30 thus drives the carriage D in a predeterminated direction in which the body W should be conveyed. The motor should be disposed in a safe place from the viewpoint of security from explosion.

The rotation of the vehicle body W may be carried out using a movement of the carriage D, that is, using a displacement of the carriage D with respect to the rails 23. The displacement of the carriage D may be converted to a force of rotation using a mechanism 31 for converting the displacement of the carriage D into rotation. The mechanism 31 comprises a rotary shaft 32 supported rotatably by the base 21 and extending in a vertical direction from the base 21, a sprocket 33 fixed on the lower end portion of the rotary shaft 32, and a chain 34 engaged with the sprocket 33. The chain 34 is disposed in parallel to the retraction wire 30 in such a state that it does not move along the rails 23. As the carriage D is retracted by the retraction wire 30, the sprocket 33 allows the rotary shaft 32 to rotate because the chain 34 is unmovable.

A force of rotation of the rotary shaft 32 is transmitted to the rotary shaft 5 of the front rotation jig 1F through a transmitting mechanism 35 which comprises a casing 36 fixed on a rearward side surface of the front support 24, a rotary shaft 37 supported rotatably to the casing 36 and extending in a longitudinal direction of the body W, a pair of bevel gears 38 and 39 for rotating the rotary shaft 37 in association with the rotary shaft 32, and a connection shaft 40 connected to the front support 25 rotatably and slidably in the longitudinal direction thereof. The connection shaft 40 is spline connected to the rotary shaft 37, as indicated by reference numeral 41 in FIG. 7. This construction permits a rotation of the connection shaft 32 to rotate the rotary shaft 40. It is understood that the rotary shaft 37 and the connection shaft 40 are arranged so as to be located on the horizontal axis l extending in a longitudinal direction of the body W. The connection shaft 40 is connected to or disconnected from the front rotary shaft 5 of the front rotation jig 1F. More specifically, as shown in FIGS. 10 to 12, the front rotary shaft 5 of the front rotation jig 1F is provided at its end portion with a connecting portion 5*b* in a cross shape, while the connection shaft 40 is provided at its end portion with a box member 40*a* having an engaging hollow portion 40*c* that is engageable tightly with the connection portion 5*b* of the front rotary shaft 5 as shown in FIGS. 10 and 12. By slidably moving the connection shaft 40 by a rod 43, for example, using a hydraulic cylinder 42, the connection portion 5*b* is connected to or disconnected from the box member 40*a* at its engaging hollow portion 40*c*. The connection shaft 40 is rotatable integrally with the rotary shaft 5. The rod 43 is disposed in a ring groove 40*b* formed on an outerperiphery of the box member 40*a*, as shown in FIG. 10, inorder to cause no interference with the rotation of the connection shaft 40. With the above arrangement, the front and rear rotary shafts 5 of the respective front and rear rotation jigs 1F and 1R are supported by the intermediate support 26 and the rear support 27 so as to be rotatable about the horizontal and longitudinal axis yet unmovable in a longitudinal direction of the body W, when the body W is lowered with respect to the carriage D in a state that the connection shaft 40 is displaced toward the right in FIG. 7. Thereafter, the connection portion 5*b* of the rotary shaft 5 is engaged with the connection shaft 40 through the engaging hollow portion 40*c* thereof, whereby the body W is allowed to rotate about the predetermined horizontal axis l by retracting the carriage D by means of the retraction wire 30. The vehicle body W can be unloaded from the carriage D in the order reverse to that described above.

As have been described hereinabove, when the paint is sprayed on surfaces extending upwardly and downwardly and on surfaces extending transversely or horizontally, as of vehicle bodies W, the problem may arise that a mass of the paint sprayed swells partially on the surfaces extending transversely or horizontally at a boundary area nearby the surface extending upwardly and downwardly due to a so-called "overspraying". It is to be noted, however, that the coating method according to the present invention can be applied to this problem and the coating method can overcome this by determining a film thickness or a depth of the difference in level of the concave portion on the substrate from the amount of the paint oversprayed.

It is to be understood that the foregoing text and drawings relate to embodiments of the present invention given by way of examples but not limitation. Various other embodiments and variants are possible within the spirit and scope of the present invention.

What is claimed is:

1. A coating method in a coating line for coating a substrate with a paint in a film thickness thicker than a thickness at which the paint sags to form a highly reflective surface coating on the substrate, comprising:

a spraying step in which the paint is sprayed to form a coat in a film thickness thicker than a thickness at which the paint sags on a surface extending at least upwardly and downwardly; and a drying step in which the substrate is rotated about its horizontal axis until the paint sprayed thereon achieves a substantially sagless state, the rotation of the substrate being carried out at a speed which is high enough to rotate the substrate from a vertical position to a horizontal position before the paint coated thereon substantially sags due to gravity yet which is low enough so as to cause no sagging as a result of centrifugal force;

wherein a surface at an edge portion of the substrate to be coated is lower than another portion thereof before the paint is sprayed in the spraying step in a film thickness thicker than the thickness at which the paint sags.

2. A coating method as claimed in claim 1, in which:

the paint contains a volatilizable solvent; and the drying step comprises a setting step and a baking step during which the ambient temperature is higher than the ambient temperature during the setting step.

3. A coating method as claimed in claim 2, in which the substrate is rotated in both the setting and baking steps.

4. A coating method as claimed in claim 3, in which the paint coated on the substrate sags in both the setting and baking steps.

5. A coating method as claimed in claim 3, in which the paint coated on the substrate sags only in the setting step.

6. A coating method as claimed in claim 2, in which the paint coated on the substrate sags only in the setting step; and the substrate is rotated in the setting step only.

7. A coating method as claimed in claim 1, in which the drying step comprises only the baking step.

8. A coating method as claimed in claim 4, in which the paint is a thermosetting paint.

9. A coating method as claimed in claim 3, in which the paint is a two-liquid reactive type paint.

10. A coating method as claimed in claim 6, in which the paint is a two-liquid reactive type paint.

11. A coating method as claimed in claim 7, in which the paint is a powder paint.

12. A coating method in a coating line for coating a substrate with a paint to form a highly reflective surface coating on the substrate, comprising:

a first step in which an edge portion of a surface of the substrate having surfaces extending upwardly or downwardly and transversely becomes lower than another portion thereof;

a second step in which the paint is sprayed on the surface of the substrate in a film thickness thicker than the thickness at which the paint sags; and a third step comprising sequential setting and baking steps in which the substrate is held in an ambient temperature during the setting step which is lower than the ambient temperature during the baking step and in which the substrate is rotated about its horizontal axis until the paint sprayed thereon achieves a substantially sagless state, the rotation of the substrate at least in the setting step being carried out at a speed which is high enough to rotate the substrate from a vertical position to a horizontal position before the paint coated thereon substantially sags due to gravity yet which is low enough so as to cause no sagging as a result of centrifugal force.

13. A coating method as claimed in claim 12, in which the first step comprises forming a coat at least at a portion other than at the edge portion thereof; and a film thickness on the edge portion thereof is thinner than on the other portion thereof.

14. A coating method as claimed in claim 13, in which the coat formed in the first step extends over a whole area of the surface of the substrate; and the film thickness on the edge portion thereof is thinner than on the other portion thereof.

15. A coating method as claimed in claim 13, in which the coat formed on the edge portion thereof in the first step is processed to become thinner than on the other portion thereof prior to the second step.

16. A coating method as claimed in claim 15, in which the coat on the edge portion thereof is processed by means of rubbing.

17. A coating method as claimed in claim 15, in which the coat formed in the first step is an intermediate coat; and the coat formed on the edge portion thereof is processed by means of grinding.

18. A coating method as claimed in claim 13, in which the coat formed in the first step is in a film thickness thinner than a thickness at which the paint sags.

19. A coating method as claimed in claim 13, in which the coat formed in the first step is in a film thickness thicker than a thickness at which the paint sags.

20. A coating method as claimed in claim 13, in which the substrate is transferred to the second step after the coat on the substrate is cured.

21. A coating method as claimed in claim 13, in which the substrate is transferred to the second step while the coat is still flowable before the coat on the substrate is cured.

22. A coating method as claimed in claim 12, in which the first step comprises lowering the edge portion of the substrate than the other portion thereof by processing the substrate on which no coat is formed.

23. A coating method as claimed in claim 13, in which:

the first step is a first overcoating step in which an overcoating paint is sprayed on a whole area of the surface of the substrate; and the second step is a second overcoating step in which the overcoating paint is sprayed on the whole area thereof;

wherein spraying in the first overcoating step is effected so as to allow a film thickness on the edge portion thereof to become thinner than on the other portion thereof.

24. A coating method as claimed in claim 12, in which the other portion thereof is an area at least adjacent to the edge portion thereof.

25. A coating method as claimed in claim 24, in which the surface of the substrate is arranged so as to gradually descend so as to become lower from the other portion to the edge portion thereof.

26. A coating method as claimed in claim 12, in which the rotation of the substrate is carried out in the baking step, too.

27. A coating method as claimed in claim 12, in which the substrate is rotated first in one direction and then in the opposite direction.

28. A coating method as claimed in claim 12, in which the substrate is rotated in one direction.

29. A coating method as claimed in claim 12, in which the paint sprayed is a thermosetting-type paint in a volatilizable solvent and the temperature of the setting step is high enough to substantially volatilize the solvent without curing the paint.

30. A coating method as claimed in claim 12, in which the substrate is a vehicle body.

31. A coating method as claimed in claim 12, in which the axis of rotation of the substrate extends in the longitudinal direction thereof.

32. A coating method as claimed in claim 12, in which the substrate is rotated intermittently.

33. A coating method as claimed in claim 12, in which the horizontal axis coincides substantially with the gravitational center of the substrate.

34. A coating method as claimed in claim 12, in which the substrate is held substantially stationary during the second step.

35. A coating method as claimed in claim 12, in which the temperature in the setting step is in the room temperature range.

36. A coating method as claimed in claim 12, in which the paint sprayed is a two-liquid reactive type paint in a volatilizable solvent; and the temperature of the setting step is high enough to substantially volatilize the solvent without curing the paint.

37. A coating method in a coating line for coating a substrate with a paint causing a thermal flow to form a highly reflective surface coating on the substrate, comprising:

a first step in which an edge portion of a surface of the substrate having surfaces extending upwardly or downwardly and transversely becomes lower than another portion thereof;

a second step in which the paint is sprayed on the surface of the substrate in a film thickness thicker than the thickness at which the paint sags; and a third step comprising hold the substrate at a given temperature curing the paint sprayed in the second step thereon, in which the substrate is rotated about its horizontal axis until the paint sprayed thereon achieves a substantially sagless state, the rotation of the substrate in the third step being carried out at a speed which is high enough to rotate the substrate from a vertical position to a horizontal position before the paint coated thereon substantially sags due to gravity yet which is low enough so as to cause no sagging as a result of centrifugal force.

38. A coating method as claimed in claim 37, in which the first step comprises forming a coat at least at a portion other than at the edge portion thereof; and a film thickness on the edge portion thereof is thinner than on the other portion thereof.

39. A coating method as claimed in claim 38, in which the coat formed in the first step extends over a whole area of the surface of the substrate; and the film thickness on the edge portion thereof is thinner than on the other portion thereof.

40. A coating method as claimed in claim 38, in which the coat formed on the edge portion thereof in the first step is processed to become thinner than on the other portion thereof prior to the second step.

41. A coating method as claimed in claim 40, in which the coat on the edge portion thereof is processed by means of rubbing.

42. A coating method as claimed in claim 40, in which the coat formed in the first step is an intermediate coat; and the coat formed on the edge portion thereof is processed by means of grinding.

43. A coating method as claimed in claim 38, in which the coat formed in the first step is in a film thickness thinner than a thickness at which the paint sags.

44. A coating method as claimed in claim 38, in which the coat formed in the first step is in a film thickness thicker than a thickness at which the paint sags.

45. A coating method as claimed in claim 38, in which the substrate is transferred to the second step after the coat on the substrate is cured.

46. A coating method as claimed in claim 38, in which the substrate is transferred to the second step while the coat is still flowable before the coat on the substrate is cured.

47. A coating method as claimed in claim 37, in which the first step comprises forming a concave portion having a difference in level so as to lower the edge portion of the substrate than the other portion thereof.

48. A coating method as claimed in claim 38, in which the first step comprises forming a concave portion having a difference in level so as to lower the edge portion of the substrate than the other portion thereof.

49. A coating method as claimed in claim 37, in which the other portion thereof is an area at least adjacent to the edge portion thereof.

50. A coating method as claimed in claim 49, in which the surface of the substrate is arranged so as to gradually descend so as to become lower from the other portion to the edge portion thereof.

51. A coating method as claimed in claim 37, in which the substrate is rotated first in one direction and then in the opposite direction.

52. A coating method as claimed in claim 37, in which the substrate is rotated in one direction.

53. A coating method as claimed in claim 37, in which the substrate is rotated intermittently.

54. A coating method as claimed in claim 37, in which the paint is a powder paint.

55. A coating method as claimed in claim 37, in which the substrate is a vehicle body.

56. A coating method as claimed in claim 37, in which the paint is a paint which causes a thermal flow.

57. A coating method as claimed in claim 37, in which the axis of rotation of the substrate extends in the longitudinal direction thereof.

58. A coating method as claimed in claim 37, in which the horizontal axis coincides substantially with the gravitational center of the substrate.

59. A coating method as claimed in claim 37, in which the substrate is held substantially stationary during the second step.

60. A coating method as claimed in claim 13, in which the first step comprises forming a coat while a masking is disposed on the edge portion of the substrate.

61. A coating method as claimed in claim 37, in which the first step comprises forming a coat while a masking is disposed on the edge portion of the substrate.

62. A coating method in a coating line for coating a substrate with a paint containing a volatilizable solvent to form a highly reflective surface coating on the substrate, comprising:

a first step in which the paint is sprayed on the substrate having surfaces extending upwardly or downwardly and transversely to form a first coat so as to become thinner in a film thickness at the edge portion thereof than on another portion thereof;

a second step in which the paint is sprayed on the surface of the first coat to form a second coat so as to have a total thickness of the coat thicker than a thickness at which the paint sags, while the first coat is still flowable before the first coat is cured; and a third step comprising hold the substrate at a given temperature curing the paint sprayed in the second step thereon, in which the substrate is rotated about its horizontal axis until the paint sprayed thereon achieves a substantially sagless state, the rotation of the substrate in the third step being carried out at a speed which is high enough to rotate the substrate from a vertical position to a horizontal position before the paint coated thereon substantially sags due to gravity yet which is low enough so as to cause no sagging as a result of centrifugal force.

63. A coating method as claimed in claim 62, in which:

the first coat has a film thickness thinner than the thickness at which the paint sags; and the second coat has a film thickness thinner than the thickness at which the paint sags.

64. A coating method as claimed in claim 62, in which:

the paint is a thermosetting paint containing a solvent; and the ambient temperature of the setting step is in the temperature range in which the solvent volatilizes.

65. A coating method as claimed in claim 62, in which:

the spraying step comprises at least an intercoating step and an overcoating step in which the paint is sprayed at two stages;

the first step is a first stage of the overcoating step; and the second step is a second stage of the overcoating step.

66. A coating method as claimed in claim 62, in which the substrate is a vehicle body.

67. A coating method as claimed in any one of claims 1, 12, 37 and 62, in which:

the substrate is a panel member; and the edge portion of the substrate is an inner circumferential edge portion around a hole opening on the panel member.

68. A coating method as claimed in any one of claims 1, 12, 37, and 62, in which:

the edge portion of the substrate is a boundary area of the surfaces extending upwardly or downwardly and transversely.

* * * * *